US006795049B2

(12) United States Patent
Toyoshima et al.

(10) Patent No.: US 6,795,049 B2
(45) Date of Patent: Sep. 21, 2004

(54) ELECTRIC CIRCUIT

(75) Inventors: Tsuyoshi Toyoshima, Hino (JP); Kazuhiro Sasaki, Sagamihara (JP); Katsuhiko Morosawa, Higashiyamato (JP)

(73) Assignee: Casio Computer Co., Ltd., Tokyo (JP)

( * ) Notice: Subject to any disclaimer, the term of this patent is extended or adjusted under 35 U.S.C. 154(b) by 223 days.

(21) Appl. No.: 10/043,905

(22) Filed: Jan. 11, 2002

(65) Prior Publication Data

US 2002/0093474 A1 Jul. 18, 2002

(30) Foreign Application Priority Data

Jan. 17, 2001 (JP) ..... 2001-009325

(51) Int. Cl.[7] ..... G09G 3/36
(52) U.S. Cl. ..... 345/93; 345/87
(58) Field of Search ..... 345/93, 87, 88, 345/89, 90, 92, 98, 99, 100; 250/208.1; 324/430; 348/151, 302, 303, 307; 349/117; 430/22

(56) References Cited

U.S. PATENT DOCUMENTS 5,173,791 A * 12/1992 Strathman et al. ..... 349/48
5,177,743 A * 1/1993 Shinoda et al. ..... 714/702
5,285,301 A * 2/1994 Shirahashi et al. ..... 349/143
5,598,178 A * 1/1997 Kawamori ..... 345/93
5,699,076 A * 12/1997 Tomiyasu ..... 345/103
5,760,757 A * 6/1998 Tanaka et al. ..... 345/93
5,838,411 A * 11/1998 Hayakawa et al. ..... 349/139
5,847,381 A * 12/1998 Isogai ..... 250/208.1
5,867,139 A * 2/1999 Tanaka et al. ..... 345/92
5,946,068 A * 8/1999 Lee et al. ..... 349/143
5,956,009 A * 9/1999 Zhang et al. ..... 345/93
5,982,470 A * 11/1999 Nakahara et al. ..... 349/153
6,111,621 A * 8/2000 Kim et al. ..... 349/54
6,169,530 B1 * 1/2001 Mori et al. ..... 345/93
6,175,348 B1 * 1/2001 Zhang et al. ..... 345/93
6,429,843 B1 * 8/2002 Zhang et al. ..... 345/93
6,515,648 B1 * 2/2003 Tanaka et al. ..... 345/100

FOREIGN PATENT DOCUMENTS

EP 1052616 A2 * 11/2000 ..... G09G/3/36
WO WO 91/0225 * 7/1991 ..... G09G/3/36

* cited by examiner

*Primary Examiner*—Vijay Shankar
*Assistant Examiner*—Nitin Patel
(74) *Attorney, Agent, or Firm*—Frishauf, Holtz, Goodman & Chick, P.C.

(57) ABSTRACT

A liquid crystal display device includes a plurality of wires provided in a display region on a substrate, a plurality of display elements provided at each of the plurality of wires, a dummy wire provided in a non-display region on the substrate, and a dummy element connected to the dummy wire so that the parasitic capacitance at the dummy wire is equal to that at each of the plurality of wires.

9 Claims, 18 Drawing Sheets

RESET

ACCUMULATION

PRECHARGE

SELECTION IN THE BRIGHT

SELECTION IN THE DARK

NON-SELECTION IN THE BRIGHT

NON-SELECTION IN THE DARK

ELECTRIC CIRCUIT

CROSS-REFERENCE TO RELATED APPLICATIONS

This application is based upon and claims the benefit of priority from the prior Japanese Patent Application No. 2001-009325, filed Jan. 17, 2001, the entire contents of which are incorporated herein by reference.

BACKGROUND OF THE INVENTION

1. Field of the Invention

The present invention relates to an electric circuit having a liquid crystal display element and an image pick-up element and more particularly, to an active matrix type electric circuit driven by a shift register.

2. Description of the Related Art

In a TFT liquid crystal display device, a TFT (Thin Film Transistor) that is an active element is provided for each pixel, and data is written into a pixel capacitance by turning ON/OFF the TFT, thereby displaying a desired image. In order to thus display such an image, in general, the TFT liquid crystal display device has a driver circuit having a gate driver and a drain driver.

The gate driver sequentially selects one of a plurality of gate lines in the TFT liquid crystal display device, and widely uses a shift register composed of a plurality of transistors. In some of such shift registers, an operation of each stage that corresponds to each gate line is controlled by a signal generated at its preceding or following stage.

An output signal outputted to a gate line of a liquid crystal element from each stage of such a shift register is damped by a distributed parameter circuit defined by the gate line and the TFT, pixel capacitance, and compensation capacitance connected to the gate line. Therefore, the distributed parameter circuit caused by each gate line and elements connected to such each gate line affects a circuit operation of the shift register.

If the number of stages of the shift resister is the same as that of lines in display pixels of the TFT liquid crystal display element, a circuit operation at the last stage is not affected by a circuit operation at the next stage, unlike the other stage. Therefore, in the circuit operation at the last stage, there occurs a slight difference from circuit operation at the preceding stage. Further, if the circuit is driven for a long period of time, there has been a problem that such a slight difference is considered as gradually affecting the preceding stages, and operation of the shift register configuring a gate driver becomes unstable.

SUMMARY OF THE INVENTION

It is an object of the present invention to provide an electric circuit such that a shift register applied as a driver is stably operated.

It is another object of the present invention to provide an electric circuit such that an area of elements formed outside of a display region or outside of an image pick-up element region is reduced, and such that the elements make the electric circuit stable.

According to one aspect of the present invention, there is provided an electric circuit comprising:

- a plurality of wires provided in a display region on a substrate;
- a plurality of display pixels provided at the plurality of wires, respectively;

- a dummy wire (single) provided in a non-display region on the substrate;

According to another aspect of the present invention, there is provided an electric circuit comprising:

- a plurality of wires provided on a substrate;
- a plurality of image pick-up elements provided at a respective one of the plurality of wires;
- a dummy wire (single) provided in a dummy element region on the substrate; and
- a dummy element (single) connected to the dummy wire so that a parasitic capacitance at a respective one of the plurality of wires is equal to that at the dummy wire.

In the above described electric circuit, a wiring load capacity in a region in which the plurality of display pixels or a plurality of image pick-up elements are formed is equal to a dummy wiring load capacity in a non-display region or dummy element region. Thus, even if stages of drivers used for a plurality of wires and dummy wire each are affected by the preceding and following stages, a stage corresponding to a respective one of a plurality of wires in a pixel region or image pick-up element region can be constantly operated without being affected by the preceding and following stages. Thus, a plurality of wires and dummy wires can be constantly selected.

In such an electric circuit, there may be provided a load having circuit characteristics equivalent to those of a circuit formed by an active element, a pixel capacitance, and a compensation capacitance that has been directly or indirectly connected. In addition, each stage of a shift register scanning the electric circuit may be constructed by using a combination of an electric field effect transistor formed in the same process as that in the active element.

The above described electric circuit may not be provided and the load may be set so as to provide circuit characteristics equivalent to those of a circuit formed by each scanning line and the parasitic capacitance and pixel capacitance of an active element that has been directly or indirectly connected.

In this way, when the capacity of a dummy capacitance equals a composite capacity of a pixel capacitance (or image pick-up element capacitance) and a compensation capacitance is formed, an area of a load occupied on a substrate can be reduced more significantly than that when a structure identical to that of each of these capacities is formed a load. Namely, a capacity consisting of the pixel capacitance (or image pick-up element capacity and compensation capacitance and a circuit having characteristics equivalent to those of a circuit composed of a wiring resistor can be formed to be very small by a width substantially corresponding to that of dummy wire. In this manner, a region in which pixels are formed, i.e., a rate of display area can be increased. Adjustment between a resister value and a capacity value can be made by adjusting a width of a dummy wire and a length of a dummy capacitance electrode.

According to another aspect of the present invention, there is provided an electric circuit comprising:

- pairs (plural) of first wires and second wires provided in an image pick-up element region on a substrate;
- image pick-up elements (plural) provided at a respective one of pairs (plural) of the first wires and second wires;
- a pair (single) of a first dummy wire and a second dummy wire provided in a dummy element region on the substrate;
- a dummy element (single) connected to a pair (single) of the first dummy wire and second dummy wire so that a parasitic capacitance of a respective one of pairs (plural) of the first wire and second wire is equal to that in a par (single) of the first dummy wire and second dummy wire; and a shift register connected to pairs (plural) of the first wires and second wires provided in the image pick-up region and a pair (single) of the first dummy wire and second dummy wire provided in the dummy element region, where the shift register has a plurality of stages according to pairs (plural) of the first wires and second wires and a pair (single) of the first dummy wire and second dummy wire, and at least part of the plurality of stages is driven according to an output signal from a next stage of the stage.

In the above described electronic device, there is provided a dummy element such that a capacity in pairs of first wires and second wires for driving image pick-up elements is equal to that in a pair (single) of first dummy wire and second dummy wire. Thus, even in the case where at least part of a plurality of stages of the shift register is driven in response to an output signal from at least part of a plurality of stages according to a pair (single) of first dummy wire and second dummy wire, signal characteristics in pairs of the first wires and second wires and signal characteristics in pair of first dummy wire and second dummy wire are uniform. Thus, the electronic device can be normally driven at a plurality of stages.

In addition, even if a signal supplied to an auxiliary dummy stage is set to be identical to that supplied to a plurality of wires, constant driving can be carried out. Thus, there is no need to set a new voltage value or amplitude signal for a dummy stage. Therefore, a voltage generator circuit and a wiring design can be simplified.

DETAILED DESCRIPTION OF THE INVENTION

Hereinafter, preferred embodiments of the present invention will be described with reference to the accompanying drawings.

Figure 1:
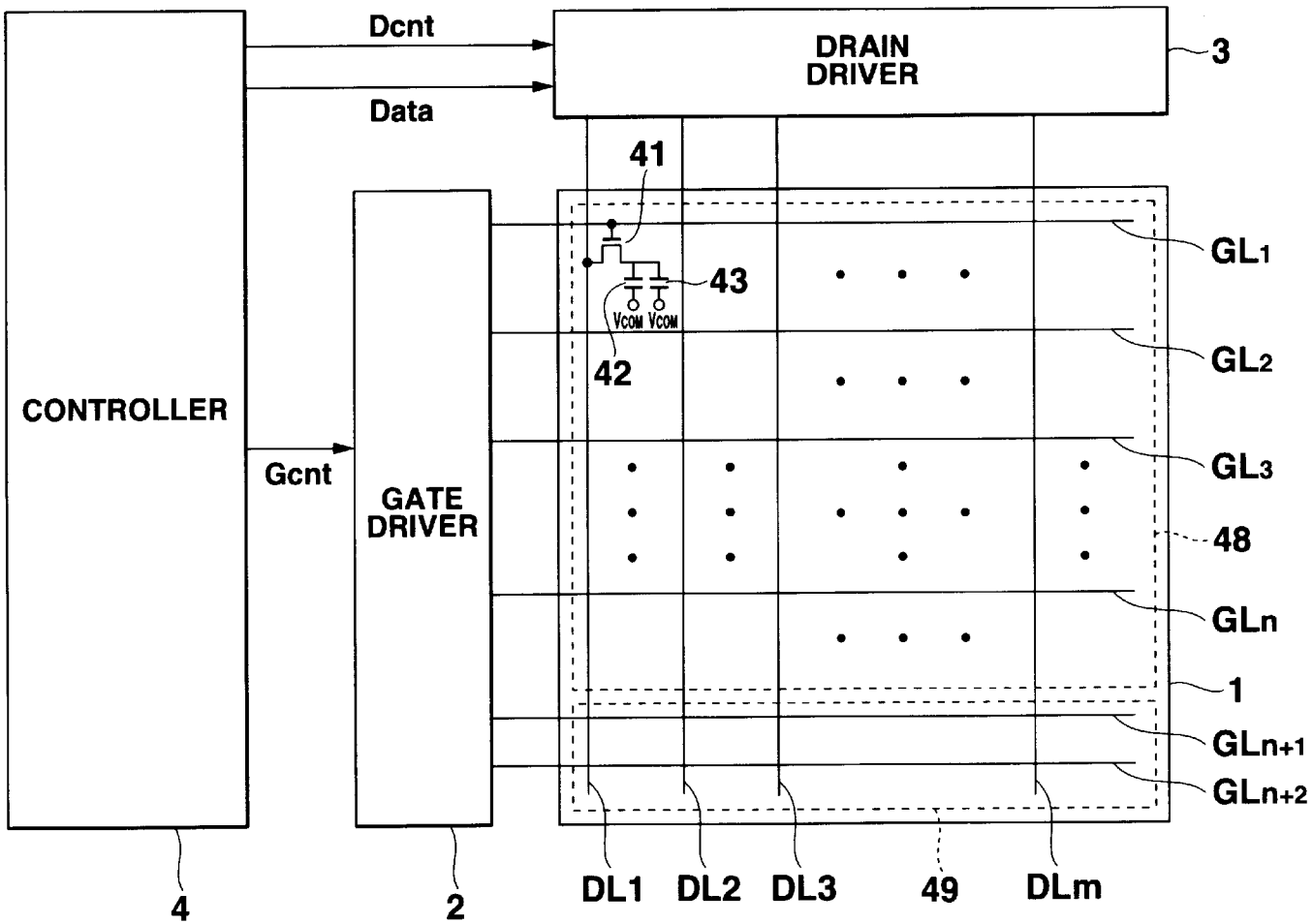
FIG. 1 is a view showing a construction of a liquid crystal display device according to one embodiment of the present invention.

FIG. 1 is an equivalent circuit diagram illustrating a construction of a liquid crystal display device according to the present embodiment. As illustrated, this liquid crystal device is composed of a liquid crystal display element 1, a gate driver 2, a drain driver 3, and a controller 4.

The liquid crystal display element 1 is constructed by sealing a liquid crystal between a pixel substrate and a common substrate. The display element comprises a display region 48 and a dummy element region 49. On the pixel substrate, "n" gate lines GL1 to GLn arranged in the display region 48 and two dummy gate lines (dummy scanning lines) GLn+1 and GLn+2 arranged in a dummy element region 49, made of the same material as that of the gate lines GL1 to GLn, and formed to be patterned together with the gate lines GL1 to GLn, are formed in parallel to each other to be extended in a main scanning direction (transverse direction in the figure). In addition, "m" drain lines DL1 to DLm are formed in parallel to each other to be extended in a sub-scanning direction (longitudinal direction in the figure) across the display region 48 and dummy element region 49.

On the pixel substrate, there are provided TFTs formed corresponding to cross positions of the gate lines GL1 to GLn and the drain lines DL1 to DLm in the display region 48, the TFTs being switching elements that configure matrix shaped pixels, respectively and pixel elements being display pixels, or the like (described later in derail). In addition, dummy elements are provided in the dummy element region 49 (described later in detail). On the pixel substrate, an orientation film is formed on these TFTs, pixel electrodes, and dummy elements. On the other hand, although a common electrode and an alignment film are formed on the common substrate, the common electrode is formed only in the range of the display electrode 48.

Figure 2A:
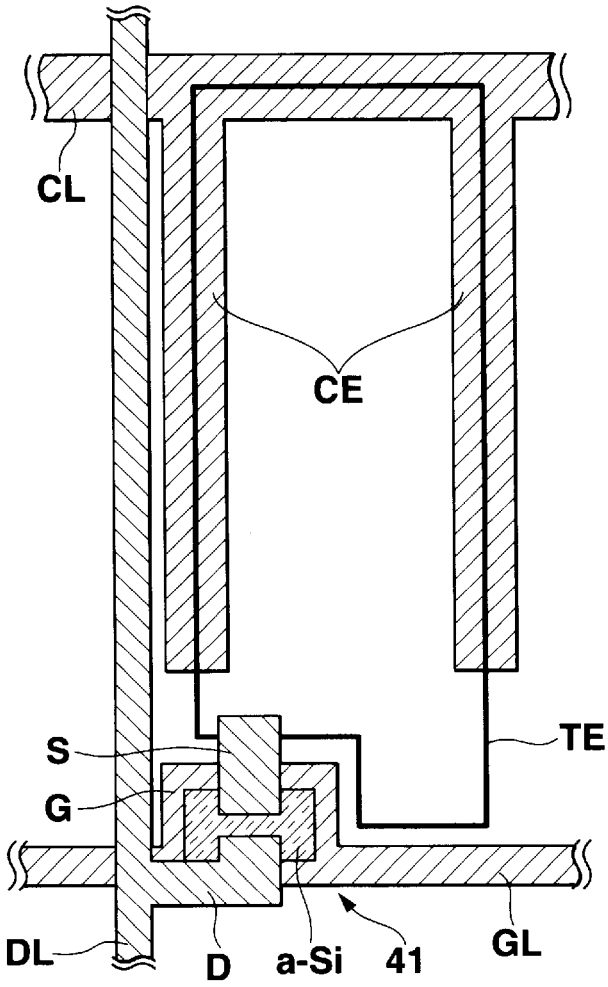
FIG. 2A is a view showing a structure of pixels formed in a display region shown in FIG. 1.
Figure 2B:
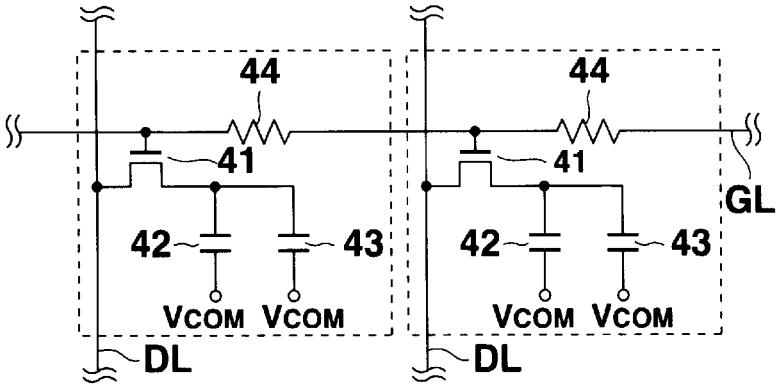
FIG. 2B is an equivalent circuit diagram of the pixels.

FIG. 2A is a view showing a structure of the pixel formed in the display region 48. In the figure, although only the pixel formed on the pixel substrate is shown, in actuality, a common electrode on the common substrate is opposed to the pixel. In addition, although an insulation layer is formed between metal layers configuring electrodes and wires, this insulation layer is not shown in the figure. FIG. 2B is a view showing an equivalent circuit of the pixels (adjacent two pixels in transverse direction).

In the display region 48, gate lines GLs (GL1 to GLn) made of a metal material and gate electrodes G of TFTs 41 formed integrally with the gate lines GL are formed in the bottom layer on the pixel substrate. In addition, compensation electrodes CE for forming a compensation capacitance 43 and a compensation electrode line CL that supplies a constant voltage to the compensation electrode CE are integrally formed. On the gate electrode G, an amorphous silicon semiconductor layer a-Si composed of amorphous silicon forming a semiconductor layer of TFT 41 is formed via a gate insulation film consisting of SiN (not shown in FIG. 2B). On both side portions of the semiconductor layer, a source electrode S and a drain electrode D are respectively provided via impurity doped layers. The source electrode S consists of a transparent ITO (Indium Tin Oxide), and is connected to a transparent electrode TE for forming a pixel capacitance 42. The gate insulation film serves as a dielectric, which configures a part of the parasitic capacitance forming the pixel.

The drain electrodes D are formed integrally with data lines DLs (DL1 to DLm) that extend in a direction orthogonal to the extension direction of the gate lines GLs. Then, an insulation protection film consisting of SiN is formed again on the TFTs 41, and an alignment film is provided thereon (these elements are not shown in FIG. 2A). The transparent electrode TE configures a capacitor together with the compensation electrode CE set at a position opposed so as to be at least partially superimposed on each other and the gate insulation film interposed between the compensation electrode CE and transparent electrodes. The compensation capacitance 43 has the compensation electrode CE, the common electrode on the common substrate, and a liquid crystal between the compensation electrode CE and common electrode. The pixel capacitance 42 has the transparent electrode TE, the common electrode, and a liquid crystal interposed between the transparent electrode TE and common electrode. A voltage VCOM is applied to both of the compensation electrode CE and common electrode.

With the thus formed structure, in each pixel, a circuit is composed of: a wire resistor 44 caused by the gate line CL; TFT 41 that is an active element whose gate is connected to the wire resistor 44; and the pixel capacitance 42 and the compensation capacitor 43 connected to drain of TFT 41 in parallel. Then, for a respective one of gate lines GL1 to GLn, distributed parameter circuits of such pixels are connected in number of pixels in a main scanning direction is constructed as a load.

Figure 3A:
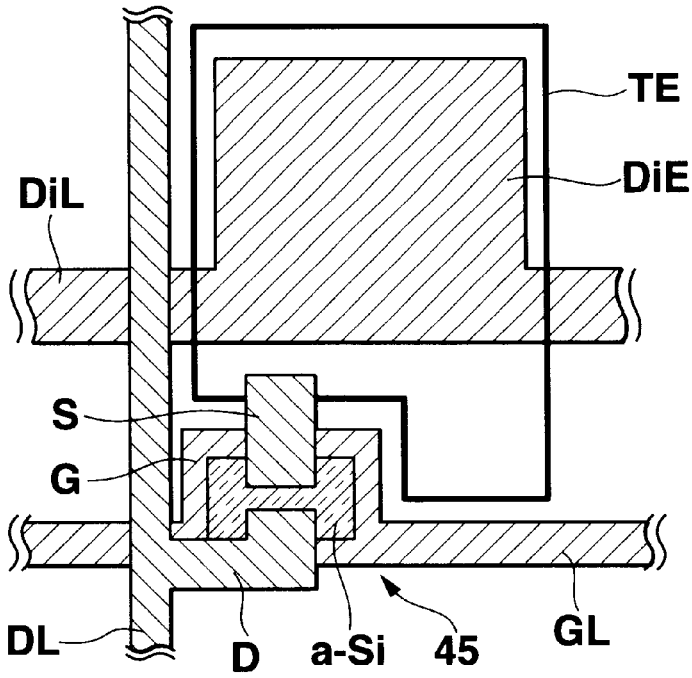
FIG. 3A is a view showing a structure of a dummy element formed in a dummy element region shown in FIG. 1.
Figure 3B:
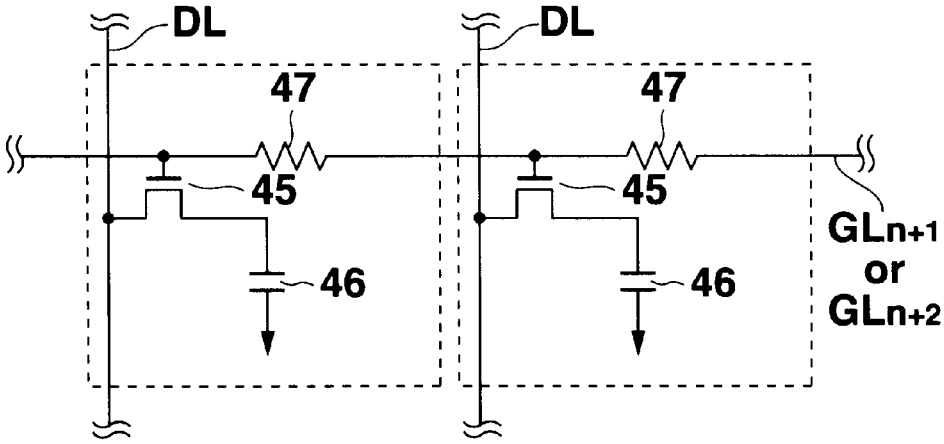
FIG. 3B is an equivalent circuit diagram of the dummy element.

FIG. 3A is a view showing a structure of the dummy element formed in the dummy element region 49. Unlike the pixel in the display region 48, a common electrode may not be opposed to the dummy element. In this figure as well, an insulation layer formed between metal layers configuring the electrodes and wires is not shown. FIG. 3B is a view showing an equivalent circuit of the dummy elements (adjacent two elements in transverse direction).

In the dummy electrode region 49, the gate lines (GLn+1, GLn+2) and a gate electrode G of TFT 45 formed integrally with the gate line CL are formed in the bottom layer on the pixel substrate. In addition, a dummy capacitance electrode DiE for forming the dummy capacitance 46 ("i" is any of 1 to m) and a dummy capacitance electrode line DiL that supplies a constant voltage to the dummy capacitance electrode DiE are formed integrally. These elements are formed of a metal material identical to that of the gate line CL or the like in the display region 49 in the same process.

An amorphous silicon semiconductor layer a-Si composed of amorphous silicon and forming a semiconductor layer of TFT 45 is formed on the gate electrode G. An insulation layer (not shown) consisting of transparent SiN is formed on these elements. On the insulation layer, a transparent electrode TE consisting of ITO is formed, which forms a dummy capacitance 46, together with the dummy capacitance electrode DiE. These elements are formed of the same material that corresponds to that in the display region 48 in the same process.

On these elements, a gate insulation layer consisting of SiN is formed. Further, on this layer, there are formed a data line DLs (DL1 to DLm: Same as those of the display region 48) consisting of a metal material, a drain electrode D of TFT 45 formed integrally with the data line DLs, and a source electrode S of TFT 45. The source electrode S and transparent electrode TE are electrically connected to each other via a contact hole. Then, an insulation protection film consisting of SiN is formed on these electrodes.

The dummy capacitance 46 is composed of the dummy capacitance electrode DiE, the transparent electrode TE, and a film identical to the gate insulation film between the dummy capacitance electrode DiE and the transparent electrode TE. With the thus formed structure, there are constructed a wiring resistor 47 caused by a dummy gate line GL; TFT 45 that is an active element of which a gate is connected to the wiring resistor 47; and a dummy element consisting of the dummy capacitance connected to a drain of TFT 45.

TFT 45 is completely identical to TFT 41 in shape, dimensions, and relative disposition relevant to data lines DLs and gate lines GLs. Thus, a capacity of the parasitic capacitance caused between TFT and the data line DLs connected thereto, and a capacity of the parasitic capacitance between the gate and drain in TFT 45 are equal to a capacity of the parasitic capacitance caused between TFT 41 and the data line DLs connected thereto, and a capacity of the parasitic capacitance between the gate and drain in TFT 41. The dummy capacitance 46 is formed so that a capacity of the dummy capacitance is equal to a composite capacity of the pixel capacitance 45 and compensation capacitance 43 in the display region 48. Then, for a respective one of gate lines GLn+1 and GLn+2 a distributed parameter circuit such dummy elements are connected in number that corresponds to the number of pixels in a main scanning direction, is formed as a load. The circuits each have characteristics identical to the load of a respective one of GL1 to Gln.

The gate driver 2 is composed of a shift register described later in detail, and high level selection signals are sequentially outputted to gate lines GL1 to GLn+1 accordance with a control signal group Gcnt from the controller 4. The drain driver 3 stores image data signals Data supplied from the controller 4 in accordance with the control signal group Dcnt supplied from the controller 4, and outputs the signals to drain lines DL1 to DLm at a predetermined timing. Transistors 501 to 506 of the gate driver 2, each having a semiconductor layer that consists of a-Si or poly-Si are TFTs formed on the pixel substrate in the same process as that of PET 41 in the display region 48 of the liquid crystal display element 1 and LET 45 in the dummy element region 49. The controller 4 supplies a control signal group Gcnt to the gate driver 2, and supplies the control signal group Dcnt and image data signals Data to the drain driver 3.

Figure 4:
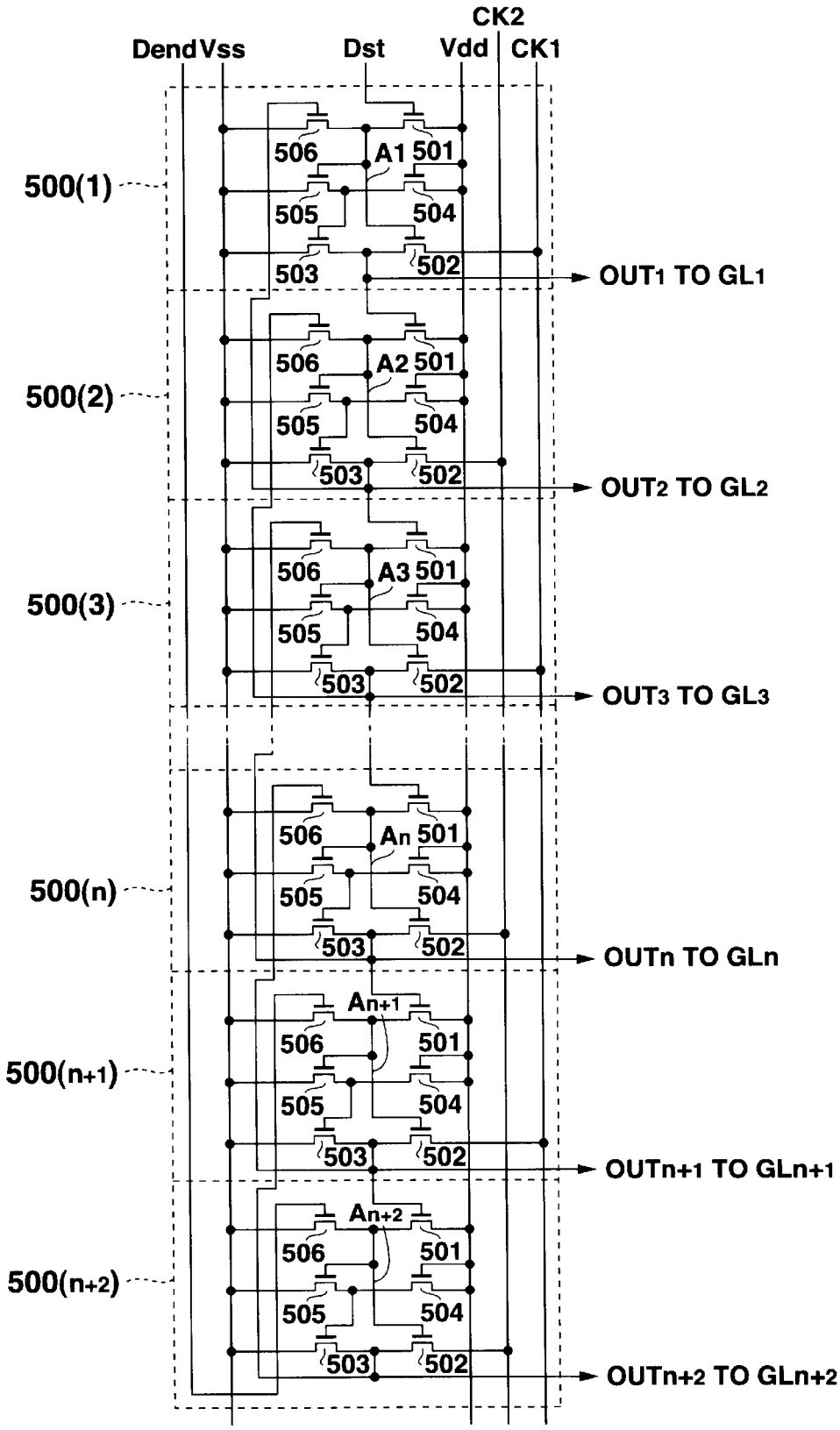
FIG. 4 is a view showing a circuit construction of a shift register that configures a gate driver shown in FIG. 1.

FIG. 4 is a view illustrating a circuit construction of a shift register that configures the gate driver 2. As illustrated, the shift register has "n+2" stages 500 (1) to 500 (*n*+2) connected corresponding to "n" gate lines GL1 to GLn arranged in the display region 48 and two gate lines GLn+1 and GLn+2 arranged in the dummy element region 49, respectively.

Clock signals CK1 and CK2, a start signal Dst, an end signal Dend, a power voltage Vdd having a positive voltage level, and a reference voltage Vss having a negative voltage level are supplied from the controller 4 as a signal included in the control signal Gcnt. The constructions of stages 500 (1) to 500 (*n*+2) are substantially identical to each other. Thus, a description is given by showing an example of a first stage 500 (1) first to sixth transistors 501 to 506 are six n-channel type electric effect transistors formed in the stage.

The start signal Dst is supplied to a gate of the first transistor 501, and a power voltage Vdd is always supplied to a drain of the first transistor. A source of the transistor 501 is connected to a gate of the second transistor 502 and a gate of the fifth transistor 505. The wire connecting the source of the first transistor 501, the gate of the second transistor 502 and the gate of the fifth transistor 505 is referred to as a node A1 (the second stage and later are defined as A2 to An+2, respectively). When, by supplying a high level start signal Dst, the first transistor 501 is turned ON, a charge is stored in the node A1.

When a clock signal CK1 is supplied to the drain of the second transistor 502, and thus the transistor 502 is turned ON, a level of the clock signal CK1 is outputted as an output signal OUT as substantially is, from the source to the first gate line GL1. The source of the second transistor 502 is connected to the third drain of the transistor 503.

A power voltage Vdd is supplied to the gate and drain of the fourth transistor 504, and thus the transistor 504 is always turned ON. The transistor 504 functions as a load when the power voltage Vdd is supplied, and the power voltage Vdd is supplied as substantially is, from its source to the drain of the fifth transistor 505. The fourth transistor 504 may be replaced with a resistor element other than TFT. A reference voltage Vss has been supplied to the source of the fifth transistor 505. When the transistor 505 is turned ON, a charge stored between the source of the transistor 504 and the drain of the transistor 505 is discharged.

An output signal OUT2 of the second stage 500(2) that is a next stage is supplied to the gate of the sixth transistor 506. The drain of the transistor 506 is connected to the node A1, and the reference voltage Vss is supplied to its source. When the output signal OUT2 is a high level, the sixth transistor 506 is turned ON, and the charge stored in the node A1 is discharged.

The construction of the other odd number stages 500 (3), 500 (5), . . . , 500 (*n*+1) is identical to that of the first stage 500 (1) except that the output signals OUT2, OUT4, . . . , OUTn of the previous stage is supplied to the gate of the transistor 501. The construction of even number stages 500 (2), 500 (4), . . . , 500 (*n*) other than the last stage is identical to that of the first stage 500 (1) except that output signals OUT1, OUT3, . . . , OUTn at the previous stage is supplied to the gate of the transistor 501, and a clock signal CK2 is supplied to the drain of the transistor 502. The construction of the last stage 500 (*n*+2) is identical to that of the first stage 500 (1) except that an output signal OUTn+1 at the previous stage is supplied to the gate of the transistor 501, and the end signal Dend included in the control signal group Gcnt is supplied to the gate of the transistor 506.

A dummy stage 500 (*n*+1) provided in the dummy element region 49 is intended to return to a reference voltage Vss the node An charged up in stage 500 (*n*) that outputs an output OUTn to GLn of the display region 48. A dummy stage 500 (*n*+2) provided in the dummy element region 49 is intended to return to a reference voltage Vss a node An+1 charged up in the dummy stage 500 (*n*+1). Thus, at stages 500 (1) to 500 (*n*), their respective stages are controlled under the same conditions, and their respective stages are controlled under the same conditions. Thus, OUT1 to OUTn outputted to the gate lines GL1 to GLn are obtained as identical constant waveforms.

Figure 5:
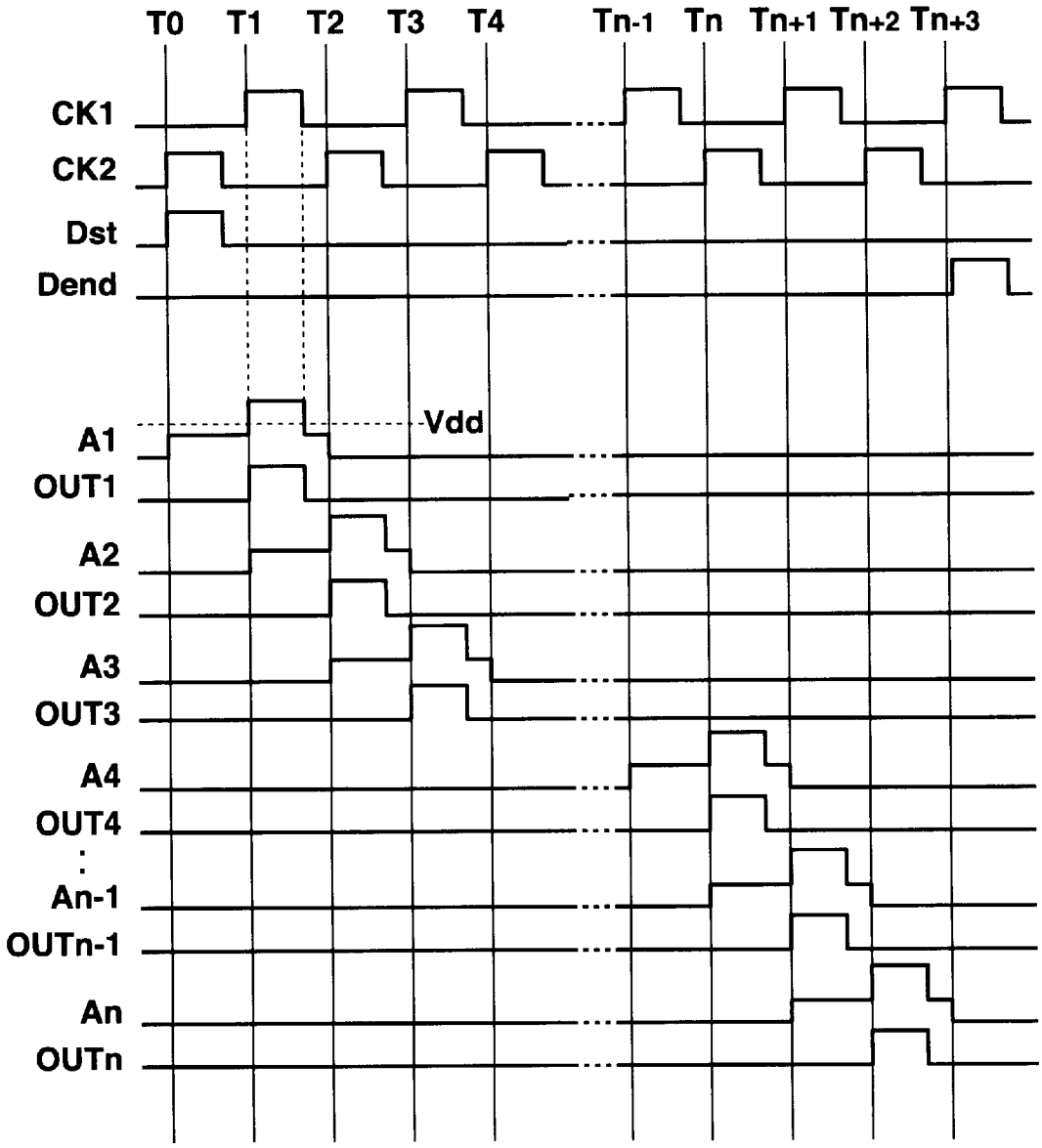
FIG. 5 is a timing chart showing an operation of the shift register shown in FIG. 4.

Hereinafter, an operation of a liquid crystal display device according to the present embodiment will be described. FIG. 5 is a timing chart showing an operation of a shift register that configures the gate driver 2. In this timing chart, a period of T is obtained as one horizontal period in the liquid crystal display element 1. In addition, in each horizontal period, the drain driver 3 acquires image data signals Data by one line that corresponds to the next horizontal period of the horizontal period in accordance with the control signal group Dcnt from the controller 4.

First, the start signal Dst enters a high level between timing T0 and timing T1, the first transistor 501 of the first stage 500 (1) is turned ON, and a charge is stored in the node A1 of the first stage 500 (1). Thus, the second and fifth transistors 502 and 505 are turned ON, and the third transistor 503 is turned OFF. Next, the clock signal CK1 is changed to a high level at timing T1, so that the level of this signal is outputted as an output signal as substantially is, to the first gate line GL1 of the display region 48.

The output signal OUT1 outputted to the gate line GL1 is damped by a circuit composed of the gate line GL1 and elements directed or indirectly connected to this gate line. This signal level is sufficient to turn ON all TFTs 41 connected to the gate line GL1. At a timing at which each TFT 41 connected to the gate line GL1 is turned ON, the drain driver 3 outputs an image data signal that corresponds to the gate line GL1 to drain lines DL1 to DLm, respectively. In this manner, the image data signal is written into the image capacitance 42 that corresponds to the gate line GL1. In this case, by the compensation capacitance 43 can suppress damping of the signal, caused by TFT 41.

When a high level output signal OUT1 is supplied to the first transistor 501 of the second stage 500 (2), between timing T1 and timing T2, a charge is stored in a node A2 of the second stage 500 (2), the second and fifth transistors 502 and 505 are turned ON, and the third transistor 503 is turned OFF. Next, when a clock signal CK2 is changed to a high level at timing T2, the level of this signal is outputted as an output signal OUT2 as substantially is, to the second gate line GL2 of the display region 48.

All TFTs 41 connected to the gate line GL2 are turned ON by the output signal OUT2 outputted to the gate line GL2 in the same manner as that described above. Thus, image data signals outputted from the drain driver 3 to drain lines DL1 to DLm are written into the pixel capacitance 42 that corresponds to the gate line GL2. The output signal OUT2 is supplied to the sixth transistor 506 of the first stage 500 (1), and the transistor 506 is turned ON, whereby the charge stored in the node Al of the first stage 500 (1) is discharged. At this time, the transistor 506 of the first stage 500 (1) as well is affected by the damping caused by an output of the gate line GL2 of the output signal OUT2.

At timing T3 and subsequent, similar operation is repeated. When an output signal at the previous stage is supplied to the first transistor 501 of n-th stage 500 (*n*) between timing Tn−1 and Tn, a charge is stored in a node An at n-th stage 500 (*n*), transistors 502 and 505 are turned ON, and the transistor 503 is turned OFF. Next, when a clock signal CK2 is changed to a high level at timing Tn, the level of this signal is outputted as an output signal OUTn as substantially is, to n-th gate line GLn of the display region 48.

All TFTs 41 connected to gate line GLn are turned ON by an output signal OUTn outputted to the gate line GLn in the same manner as that described above. Thus, an image data signal outputted from the drain driver 3 to the drain lines DL1 to DLm is written into the pixel capacitance 42 that corresponds to the gate line GLn. The output signal OUTn is supplied to the sixth transistor 506 of *n*-1-th stage 500 (*n*−1), so that the transistor 506 is turned ON, whereby a charge stored in a node An−1 at the *n*−1−th stage 500 (*n*−1) is discharged.

Further, an output signal OUTn is supplied to the first transistor 501 of the n+1-th stage 500 (*n*+1), between timing Tn and timing Tn+1, whereby a charge is stored in a node An+1 of the n+1-th stage 500 (*n*+1), the transistors 502 and 505 are turned ON, and the transistor 503 is turned OFF. Next, when the clock signal CK is changed to a high level at timing Tn+1, the level of this signal is outputted as an output signal OUTn+1 as substantially is, to the n+1-th gate line GLn+1 (first line in dummy element region 49 only).

All TFTs 45 connected to the gate line GLn+1 are turned ON by the output signal OUTn+1 outputted to the gate line GLn+1. Thus, a load composed of the gate line GLn+1 and elements directly or indirectly connected thereto is equal to that of the above describe any one of gate lines GL1 to GLn. The output signal OUT2 is supplied to the sixth transistor 506 of n-th stage 500 (*n*) while the output signal is damped by the gate line a load consisting of the gate line GLn+1 and elements connected thereto, and the transistor 506 is turned ON, whereby the charge stored in a node An of the n-th stage 500 (*n*) is discharged.

In addition, an output signal OUTn+1 is supplied to the first transistor 501 at the n+2-th stage 500 (*n*+2) between timing Tn+1 and Tn+2, and a charge is stored in a node An+2 of the n+2-th stage 500 (*n*+2). When a clock signal CK2 is changed to a high level at timing Tn+2, the level of this signal is outputted as an output signal OUTn+2 as substantially is, to the n+2-th gate line GLn+2 (second line in dummy element region 49 only). The output signal OUTn+2 is supplied to the transistor 506 at the n+1 stage 500 (*n*+1) while the signal is damped by a load consisting of the gate line GLn+2 and elements connected to the gate line GLn+2. Then, the charge stored in the node An+1 at the n+1-th stage 500 (*n*+1) is discharged.

Further, at timing Tn+3, a high level end signal Dend is supplied as a control signal group Gcnt from the controller 4, to transistor 506 at the n+2-th stage 500 (*n*+2), and thus the transistor 506 is turned ON. In this manner, the charge stored in the node An+2 of the n+2-th stage 500 (*n*+2) is discharged. Hereinafter, the above described operation is repeated every vertical period.

As has been described above, in the liquid crystal display device according to the present embodiment, the dummy element region 49 is provided outside of the display region 48 in the liquid crystal display element 1. In the dummy element region 49, and a distributed parameter load caused by each of gate lines GL1 to GLn in the display region 48 and elements directly or indirectly connected to the gate line is constructed relevant to a respective one of gate lines GLn+1 and GLn+2. Then, the shift register configuring the gate driver 2 undergoes scanning for gate lines GLn+1 and GLn+2 in the dummy element region 49 in the same way.

Thus, the load of a respective one of the gate lines GLn+1 and GLn+2 and the transistor configuration are equal to that of a respective one of the gate lines L1 to GLn and the transistor configurations. Thus, signals CK1 and CK2 and voltages Vdd and Vss with predetermined amplitudes supplied to the gate lines GL1 to GLn, respectively, can be used as signals and voltages supplied to the gate lines GLn+1 and GLn+2, respectively. In addition, there is no need to set a signal with its new voltage value and amplitude for the dummy stages 500 (*n*+1) and 500 (*n*+2). Thus, a voltage generator circuit and wiring design can be simplified. Then, the n+1-th and n+2-th dummy stages 500 (*n*+1) and 500 (*n*+2) of the shift register that correspond to the last gate line GLn in the display region 48 can be operated constantly. Thus, the n-th stage 500 (*n*) as well has operational characteristics which are similar to those of the previous stage, and thus operation of the shift register required for displaying an image can be stabilized.

Each dummy element formed in the dummy element region 49 has a dummy capacitance 46 of which a capacity is capacitance 42 and compensation capacitance 43 of each pixel formed in the display region 48. The dummy capacitance 46 is not required for display. Thus, there is no need to consider a pixel opening rate. The dummy capacities are present on the same substrate, and an interval between the electrodes is smaller than that between the electrodes of the pixel capacitance 42. Thus, a required area can be reduced more significantly than that of the pixel capacities 42. Thus, an area required to form a load equal to that of each of the gate lines GL1 to GLn in the display region 48 can be reduced in the dummy element region 49, and thus an area of the display region 48 can be relatively increased.

According to the present invention, various modifications and applications can occur without being limited to the above described embodiment. Hereinafter, a modified embodiment of the above embodiment applicable to the present invention will be described.

In the above described embodiment, the gate lines GLn+1 and GLn+2 in the dummy element region 49 are constructed in the same width as that of the gate lines GL1 to GLn in the display region 48, and thus the wiring resistor 47 has the same resistance value as the wiring resistor 44. In addition, capacity of the dummy capacitance 46 equals the composite capacity of the pixel capacitance 42 and compensation capacitance 43 is formed, thereby configuring the dummy element. However, a construction of the dummy element is not limited thereto.

Figure 6A:
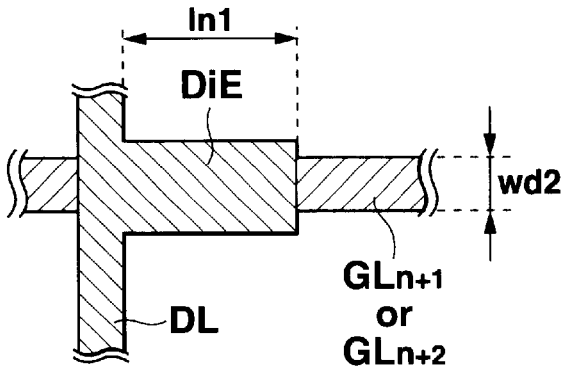
FIG. 6A is a view showing another structure of a dummy element.
Figure 6B:
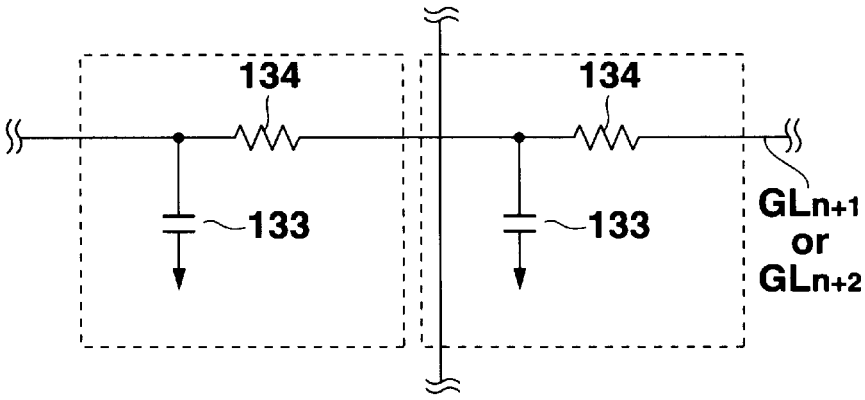
FIG. 6B is an equivalent circuit diagram of the dummy element.

FIG. 6A is a view showing another structure of a dummy element. A common electrode is not opposed to this dummy element. In this figure as well, an insulation layer formed between metal layers each configuring an electrode or wire is not shown. FIG. 6B is a view showing an equivalent circuit of dummy elements (adjacent two elements in horizontal direction). That is, in a liquid crystal display device having pixels shown in FIG. 2A, each dummy capacity 133 is set so that a capacity of the dummy capacitance 133 is a composite capacity among the parasitic capacity of TFT (active element) 41 that consists of the parasitic capacitance with the gate line GL of the TFT 41 and the parasitic capacitance with the drain line DL; the capacity of the pixel capacitance 42; and the capacity of the compensation capacitance 43.

In this case, in the dummy element region 49, at the lowest layer on the pixel substrate, there are formed two dummy gate lines GLn+1 and GLn+2, each of which consists of the same material as the gate lines GL1 to GLn, is formed to be patterned integrally with the gate lines GL1 to GLn, and has a capacity equal to that of each of the gate lines GL1 to GLn. On the gate line GL, one or more insulation layers consisting of SiN are formed. On this layer, data lines DLs (DL1 to DLm: Same as those of the display region 48) are formed. On each data line DL, there is formed a dummy capacitance electrode DiE ("i" is any of 1 to m) formed integrally with each data line, the dummy capacitance electrode protruding toward the dummy gate lines GLn+1 and GLn+2. A dummy capacitance 133 is formed of superimposed portions of the dummy capacitance electrode DiE and each of the dummy gate lines GLn+1 and GLn+2. That is, data lines DL1 ("i" is any of 1 to m) each are connected to the dummy capacitance electrode DiE at each site crossing the dummy gate line GL.

With the thus formed structure, there are constructed a wiring resistor 134 caused at a portion free of being superimposed on the dummy capacitance electrode DiE of the dummy gate lines GLn+1 and GLn+2; and a dummy electrode consisting of a dummy capacitance 133 connected to this resistor. A resistance value of the wiring resistor 134 and the capacity value of the dummy capacitance 133 are adjusted by adjusting a width wd1 of each of the dummy gate lines GLn+1 and GLn+2 and a length 1n1 of the dummy capacitance electrode DiE. Then, a load on which such a dummy element is connected in number of pixels in a main scanning direction is constructed for a respective one of the dummy gate lines GLn+1 and GLn+2. Each of these distributed parameter elements equals to a load on a respective one of the gate lines GL1 to GLn.

This makes it possible to constantly operate n-th stages 500 (*n*) of a shift register that configures a gate driver 2 in the same manner as the previous stage. In addition, the dummy element having the above construction can be constructed to be smaller than the dummy element shown in the above embodiment. This makes it possible to increase a rate of an area in the display region 48 in the liquid crystal display element 1 more significantly than that according to the above embodiment.

In the above embodiment, two gate lines GLn+1 and GLn+2 are provided in the dummy element region 49. However, an arbitrary number of gate lines can be formed in the dummy element region 49. More gate lines in the dummy element region 49 can operate a shift register that configures the gate driver 2 more constantly. Less gate lines can increase an area ratio of the display region 48 more significantly. Here, how many gate lines are formed in the dummy element region 49 can be selected by a balance between stability operation of the circuit and an area of the display region.

Figure 6C:
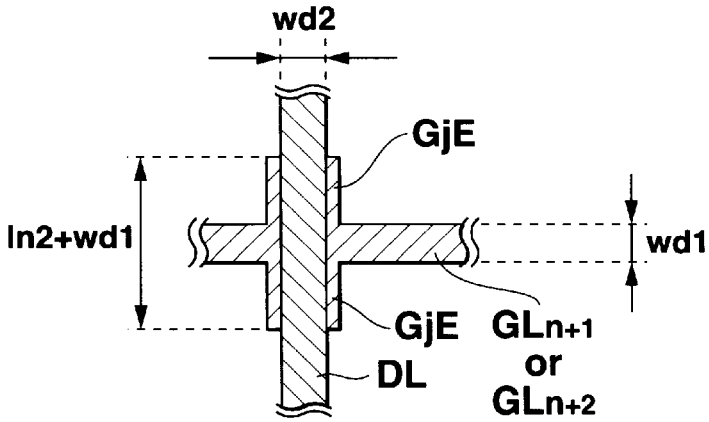
FIG. 6C is a view showing a still another structure of the dummy element.

In addition, instead of the dummy capacitance electrode DiE of FIG. 6A shown in the above modification, as shown in FIG. 6C, a dummy capacitance electrode GjE ("j" is any of 1 to m) provided integrally with each of the dummy gate lines GLn+1 and GLn+2 may be used. That is, a respective one of the dummy gate lines GLn+1 and GLn+2 is connected to dummy capacitance electrodes G1E, G2E, G3E, . . . , GmE provided for each site crossing data lines DL1, DL2, DL3, DLm. Here, when a width of the data line DL is defined as wd2, and a length in the longitudinal direction of the dummy capacitance electrode GjE (in the extension direction of the DL data line is defined as 1n2, an area (wd2×1n2) of a superimposed portion of the data line DL on the dummy capacitance electrode GjE is designed so as to be equal to an area (wd1×1n1) in the above embodiment.

Although the dummy capacitance electrodes GjE are provided at two portions across the dummy gate line GL, this electrode may be provided either of these portions, as shown in FIG. 6A as long as the above area is defined. Similarly, the dummy capacitance electrodes DiE shown in FIG. 6A may be provided at two portions in the transverse direction (in the extension direction of the dummy gate line GL) across the data line DL.

The number of dummy elements provided in one dummy gate line CL described in the above embodiments each is equal to that of pixels provided in one gate line CL. If a capacity of one dummy gate line is equal to the total capacity of the parasitic capacitance in one gate line GL, the number of dummy elements in the one dummy gate line may be different from the number of pixels as in only one dummy parasitic capacitance element in one dummy gate line GL, for example.

Figure 7:
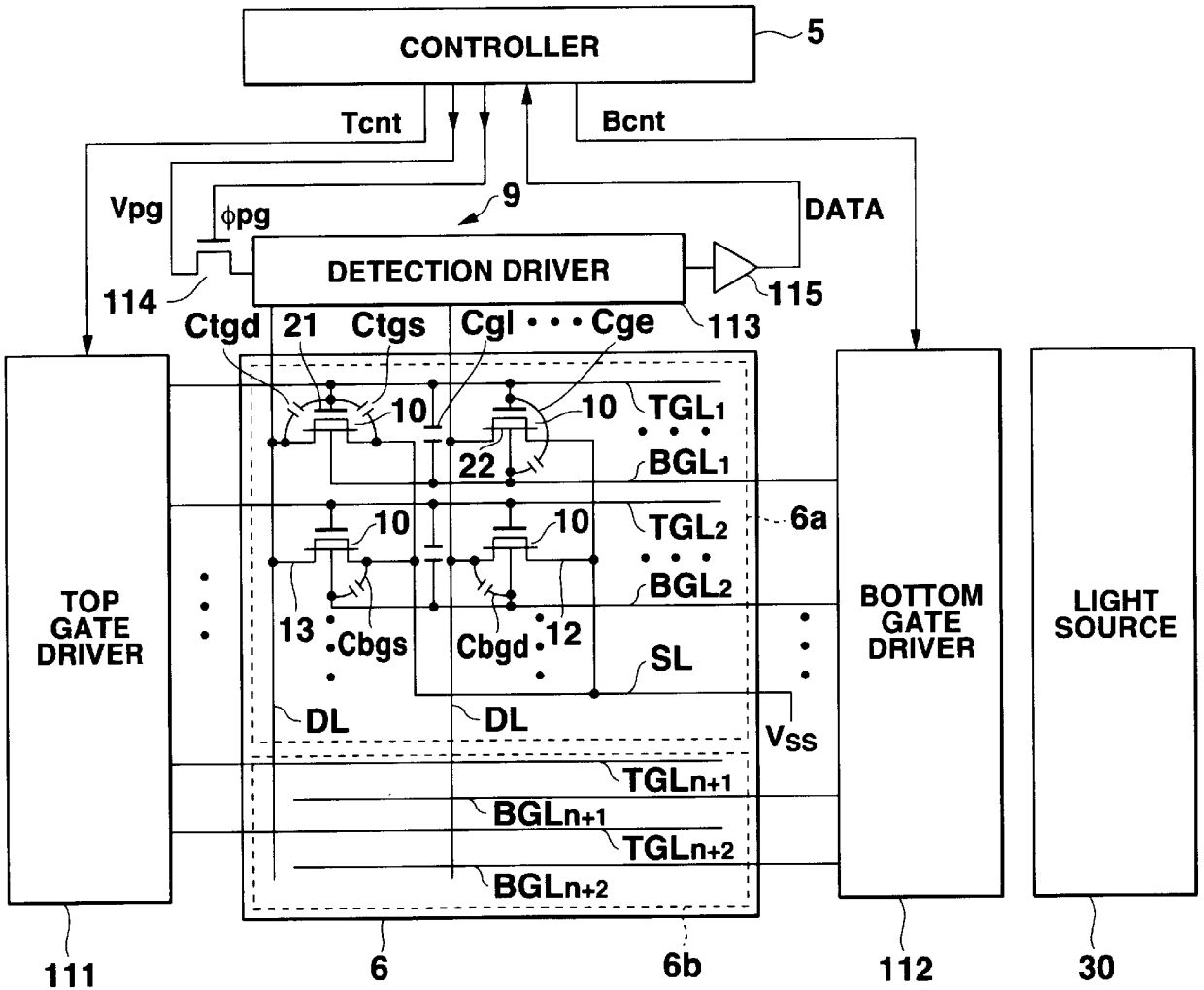
FIG. 7 is a block diagram depicting a construction of an image pick-up device according to one embodiment of the present invention.

Although the above embodiments each have described a liquid crystal display device, a construction of the gate driver 2 can apply to a gate driver of an image pick-up element. FIG. 7 is a block diagram depicting a construction of an image pick-up device having an image pick-up element that applies a double gate type transistor as a photo sensor in a third embodiment. This image pick-up device is used as a finger print sensor, for example. As illustrated, the image pick-up device is composed of a controller 5, an image pick-up element 6, a top gate driver 111, a bottom gate driver 112, a drain driver 9, and a planar light source 30 having a back light and a scattering plate. The drain driver 9 is composed of: a detection driver 113 connected to "m" drain lines DL; a switch 114 that selectively outputs a pre-charge voltage Vpg from the control 5 to the detection driver 113; and an amplifier circuit 115 that amplifies a voltage signal read out from the detection driver 113. An image pick-up may be carried out by utilizing external light such as sun light or illumination, instead of the planar light source 30.

First, a double gate type photo sensor 10 applied to an image reader device according to the present invention will be described with reference to the accompanying drawings.

Figure 8:
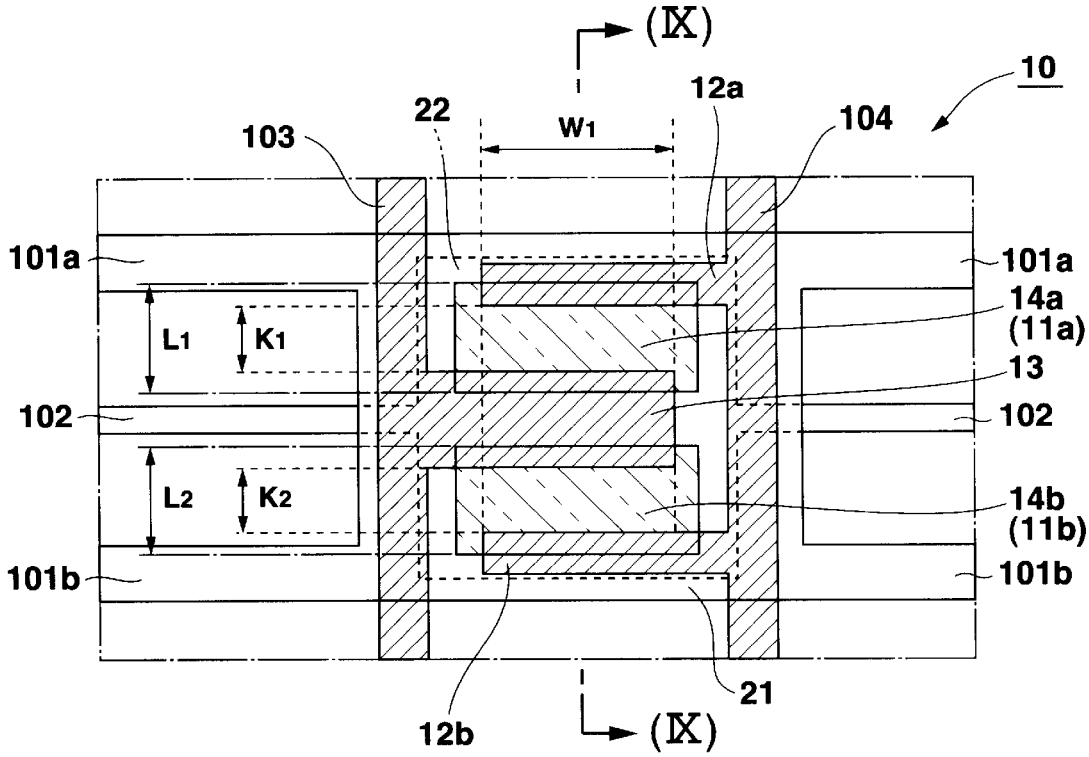
FIG. 8 is a view showing a structure of each image pick-up element formed in an image pick-up element region shown in FIG. 7.
Figure 9:
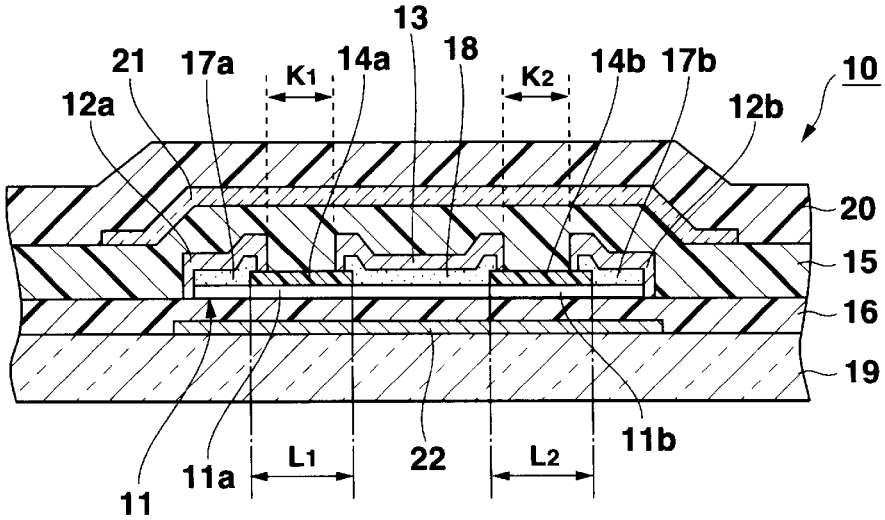
FIG. 9 is a sectional view taken along line (IX)—(IX) shown in FIG. 8.

FIG. 8 is a general plan view showing a double gate type photo sensor 10 applied to a photo sensor array according to the present invention. FIG. 9 is a sectional view taken along the line (IX)—(IX). Here, a description will be specifically given by showing a general construction of a double gate type photo sensor 10 including a plurality of double gate type photo sensor element each comprising one semiconductor layer that is a photo sensor section for the element, a channel region of the semiconductor layer being divided into two sections.

Each element of the double gate type photo sensor 10 according to the present invention is composed of: a single bottom gate 22 formed on an insulation substrate 19 that shows a visible light transmission characteristics; a bottom gate insulation film 16 provided on the bottom gate electrode 22 and the insulation substrate 19; a single semiconductor layer 11 provided to be opposed to the bottom gate electrode 22, the semiconductor layer consisting of amorphous silicon or the like in which, when visible light is incident, electron — positive hole pairs are generated; block insulation films 14*a* and 14*b* disposed in parallel to be spaced from each other on the semiconductor layer 11; impurity doped layers 17*a* and 17*b* provided respectively on both ends of the semiconductor layer 11 in a channel lengthwise direction; an impurity doped layer 18 provided to be spaced from the impurity doped layers 17*a* and 17*b* on the center of the semiconductor layer 11; source electrodes 12*a* and 12*b* provided respectively on the impurity doped layers 17*a* and 17*b*; a drain electrode 13 provided on the impurity doped layer 18; block insulation films 14*a* and 14*b*, the bottom gate insulation film 16, source electrodes 12*a* and 12*b*; a top gate insulation film 15 formed so as to cover source electrodes 12*a* and 12*b*, and drain electrode 13; a single top gate electrode 21 provided at a site on the top gate insulation film 15 opposed to the semiconductor 11; and a protection insulation film 20 provided on the top gate insulation film 15 and the top gate electrode 21.

Figure 10:
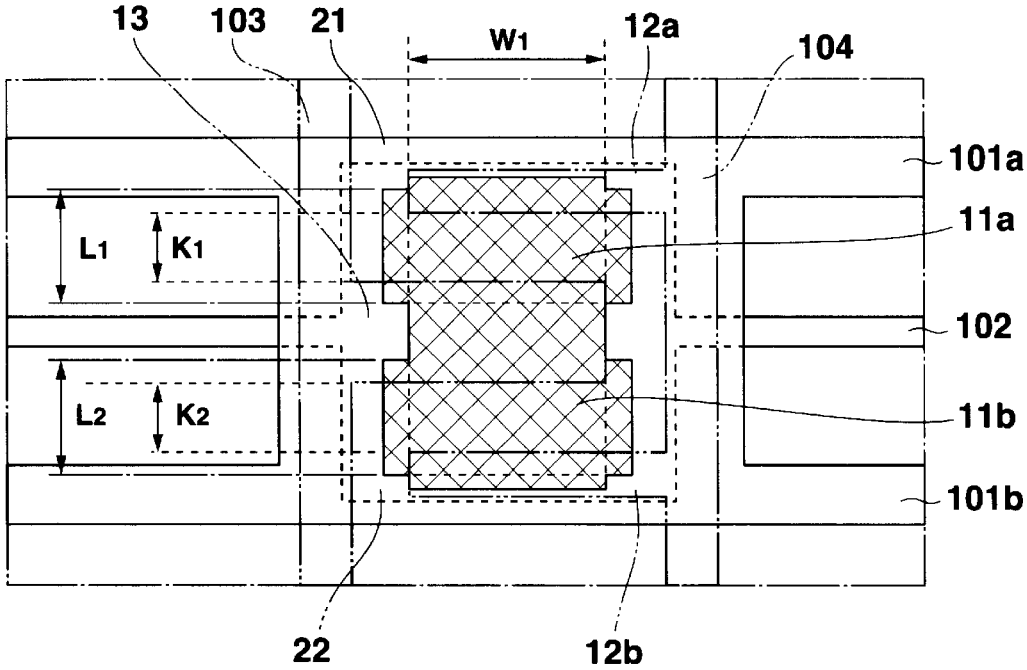
FIG. 10 is a plan view showing a position of a semiconductor layer in an image pick-up element.

As shown in FIG. 10, the semiconductor layer 11 is formed in a region hatched in a lattice. This layer has portions on which there are superimposed the source electrodes 12*a* and 12*b* and drain electrode 13, and the channel regions 11*a* and 11*b* arranged in parallel in the channel lengthwise direction (y direction).

Figure 11:
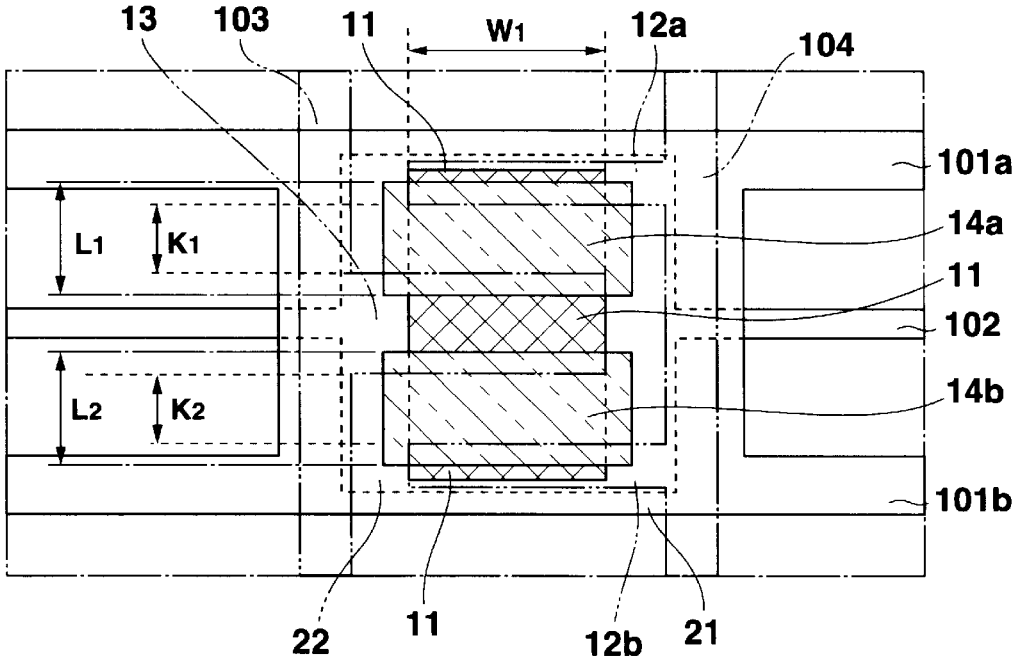
FIG. 11 is a plan view showing a relative position between a semiconductor layer and a block insulation film of the image pick-up element.

As shown in FIG. 11, the block insulation film 14*a* has both ends on which the source electrode 12*a* and the drain electrode 13 are superimposed. The block insulation film 14*b* is disposed so as to be superimposed with the source electrode 12*b* and drain electrode 13 at both ends thereof in partial.

Figure 12:
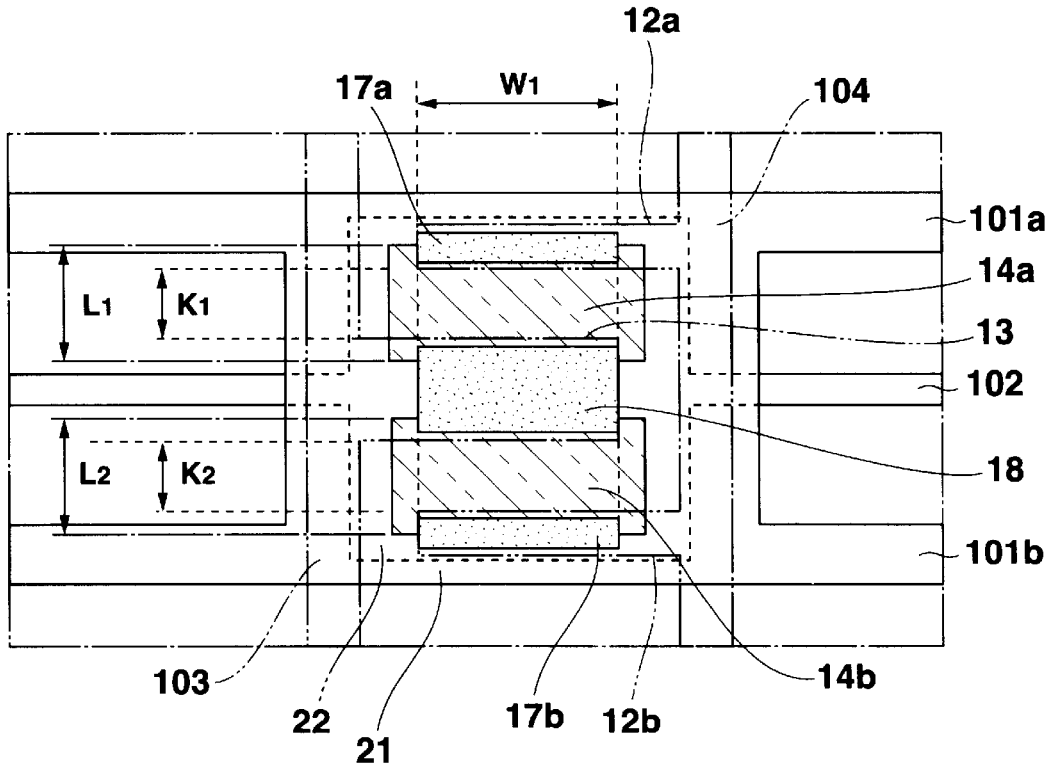
FIG. 12 is a plan view showing a relative position between the block insulation film and an impurity doped layer of the image pick-up element.

As shown in FIG. 12, the impurity doped layers 17*a*, 17*b*, and 18 each consist of n-type impurity ion doped amorphous silicon ($n^+$-type silicon). The impurity doped layer 17*a* is interposed between one end of the semiconductor layer 11 and the source electrode 12*a*, part of which is disposed on the block insulation layer 14*a*. The impurity doped layer 17*b* is interposed between the other end of the semiconductor layer 11 and the source electrode 12*b*, part of which is disposed on the block insulation film 14*b*. The impurity doped layer 18 is interposed between the semiconductor layer 11 and the drain electrode 13, both ends of which are disposed on the block insulation films 14*a* and 14*b*, respectively.

Here, the source electrodes 12*a* and 12*b* are formed to be protruded in a comb tooth shape along an x direction toward a drain line 103 from a common source line 104. The drain electrode 13 is formed to be protruded toward the source line 104 along the x direction from the drain line 103 opposed to the source line 104. That is, the source electrode 12*a* and drain electrode 13 are disposed to be opposed to each other by sandwiching a region 11*a* of the semiconductor 11. The source electrode 12*b* and drain electrode 13 are disposed to be opposed by sandwiching a region 11*b* of the semiconductor 11.

In FIG. 9, the block insulation films 14*a* and 14*b*, top gate insulation film 15, bottom gate insulation film 16, and protection insulation film 20 provided on the top gate electrode 21 each consist of a light transmission insulation film such as silicon nitride. The top gate electrode 21 and top gate lines 101*a* and 101*b* each are made of light transmission electrically conducting material such as ITO described above, and each of these elements shows a high transmission light relevant to visible light. The source electrodes 12*a* and 12*b*, drain electrode 13, bottom gate electrode 22, and bottom gate line 102 are composed of a material which interrupts transmission of visible light selected from electrically conducting metal such as chrome, chrome array, aluminum, or aluminum alloy.

The above structured double gate type photo sensor 10 is composed of first and second double gate type photo sensor sections. The first section is constructed by first top and bottom MOS transistors. The second section is constructed by second top and bottom MOS transistors. The first top MOS transistor includes the channel region 11*a* of the semiconductor layer 11, source electrode 12*a*, drain electrode 13, top gate insulation film 15, and top gate electrode 21. The first bottom MOS transistor includes the channel region 11*a*, source electrode 12*a*, drain electrode 13, bottom gate insulation film 16, and bottom gate electrode 22. The second top MOS transistor includes the channel region 11*b* of the semiconductor layer 11, source electrode 12*b*, drain electrode 13, top gate insulation film 15 and top gate electrode 21. The second bottom MOS transistor includes the channel region 11*b*, source electrode 12*b*, drain electrode 13, bottom gate insulation film 16, and bottom gate electrode 22. The first and second double gate type photo sensor sections are constructed to be disposed on the insulation substrate 19 in parallel.

The channel region 11*a* through which a drain current of the first double gate type photo sensor section of the double gate type photo sensor 10 flows is set in a rectangular shape in which the adjacent two sides are defined by a channel length $L_1$ and a channel width $W_1$. The channel 11*b* through which a drain current of the second double gate type photo sensor section flows is defined in a rectangular shape in which the adjacent two sides are defined by a channel length $L_2$ and a channel width $W_1$.

A carrier generation region in which light irradiates the upper surface of the double gate type photo sensor 10 is incident, the carrier generation region affecting a drain current Ids of the first double gate type photo sensor, is substantially formed as a rectangle whose longitudinal length is $K_1$ and whose transverse length is $W_1$, and is approximate to the shape of the channel region 11*a*. A carrier generation region in which the upward light of the double gate type photo sensor 10 is incident, the carrier generation region affecting a drain current Ids of the second double gate type photo sensor, is substantially formed as a rectangle whose longitudinal length is $K_2$ and whose transverse length is $W_1$, and is substantially approximate to the shape of the channel region 11*b*.

The top gate line 101 corresponds to each of the top gate lines TGL1 to TGLn+2 shown in FIG. 7, and is formed of ITO together with the top gate electrode 21. The bottom gate line 102 corresponds to each of the bottom gate lines BGL1 to BGLn+2, and is formed of the same electrically conducting material as that of the bottom gate electrode 22.

The drain line 103 corresponds to the drain line DL shown in FIG. 7, and is formed of the same electrically conducting material as that of the drain electrode 13. The source line 104 corresponds to the source line SL, and is formed of the same electrically conducting material as that of the source electrode 12.

In such a construction, a photo sensing function is achieved by applying a voltage to the top gate terminal TG from the top gate driver 111. A voltage is applied from the bottom gate driver 112 to the bottom gate terminal BG, a detection signal is acquired by the detection driver 113 via the drain line 103. Then, the acquired signal is outputted as serial data or parameter data DATA, whereby a selective readout function is achieved.

Now, a method for driving and controlling the above described photo sensor system will be described with reference to the accompanying drawings.

Figure 13:
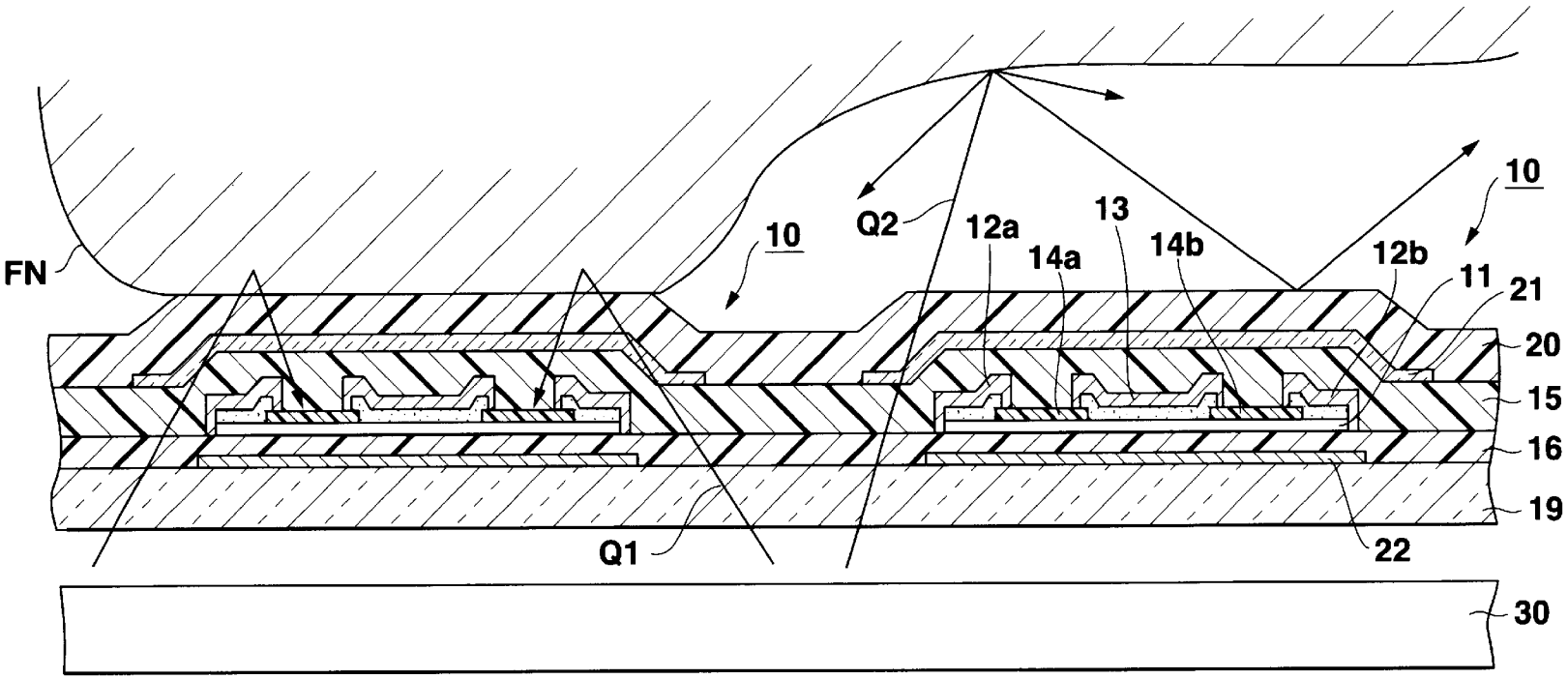
FIG. 13 is a sectional view showing a state when a finger is placed on a photo sensor system.
Figure 14:
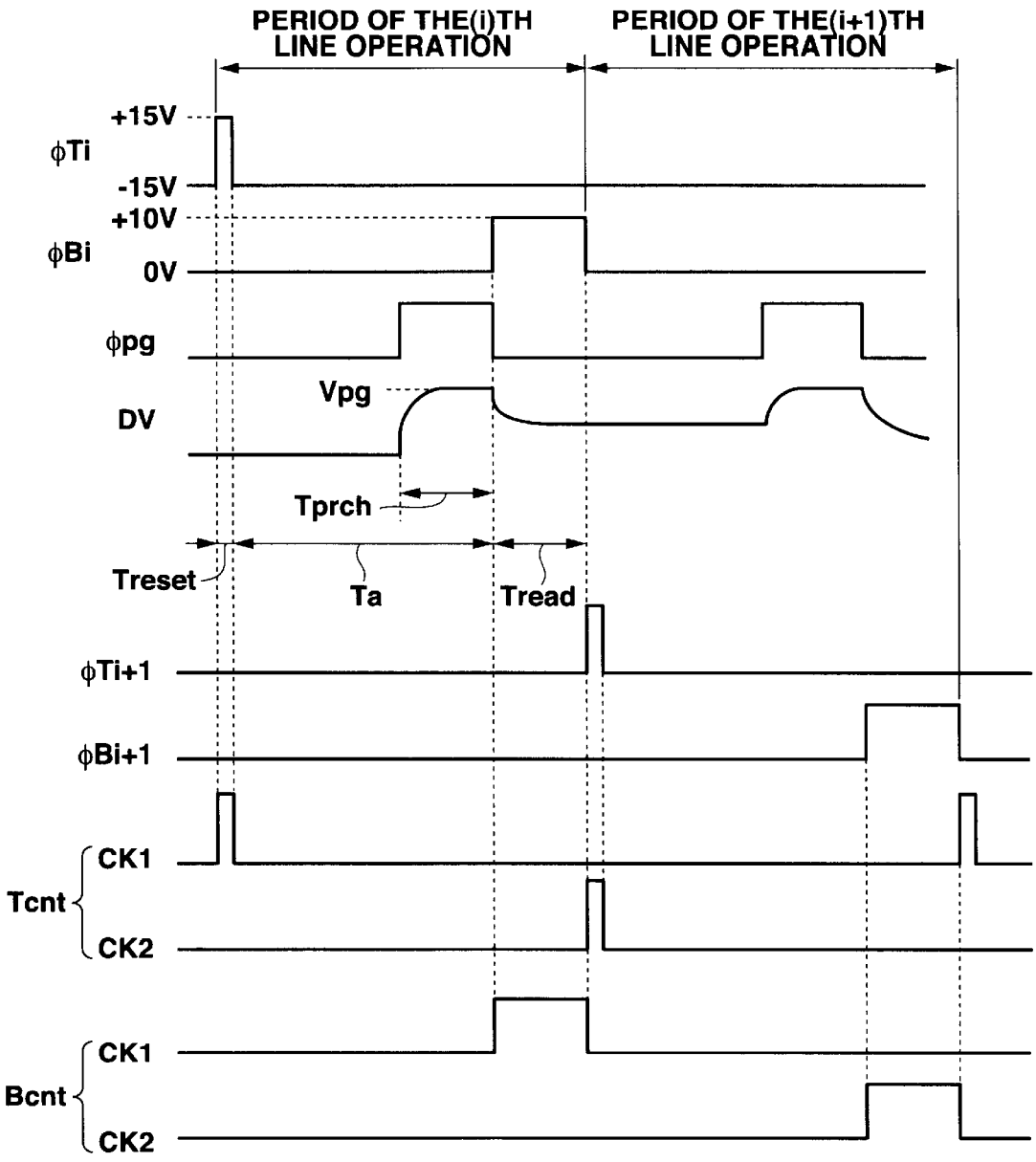
FIG. 14 is a timing chart for illustrating an example of a driving control method in the photo sensor system.
Figure 20:
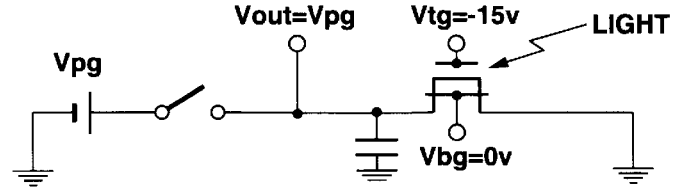
FIG. 20 is a view for illustrating a non-selection mode operation of the double gate type photo sensor in a bright state.
Figure 21:
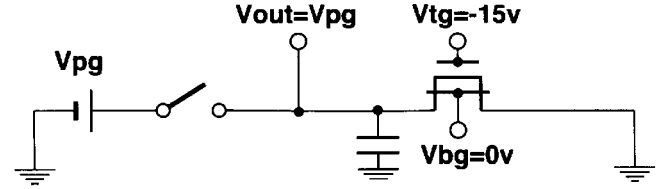
FIG. 21 is a view for illustrating a non-selection mode operation of the double gate type photo sensor in a dark state.
Figure 22:
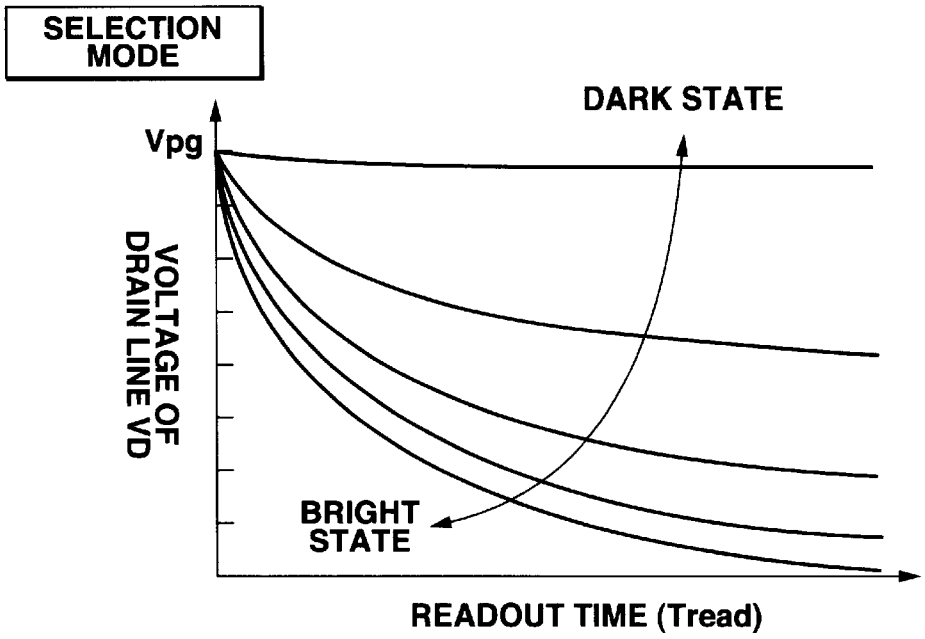
FIG. 22 is a view for illustrating drain voltage characteristics of the double gate type photo sensor in a selection mode.
Figure 23:
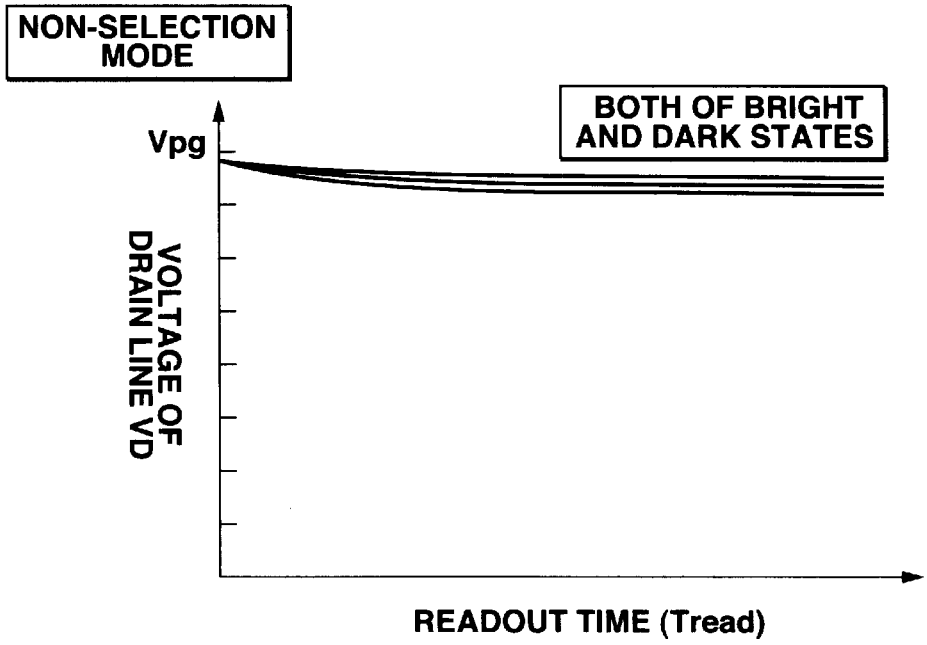
FIG. 23 is a view showing drain voltage characteristics of the double gate type photo sensor in a non-selection mode.

FIG. 13 is a sectional view showing a state when a finger is placed on the photo sensor system 100. FIG. 14 is a timing chart showing an example of a method of driving and controlling the photo sensor system 100. FIGS. 15 to 21 are conceptual views each showing an operation of the double gate type photo sensor 10. FIGS. 22 and 23 are views each showing light response characteristics of an output voltage of the photo sensor system.

Figure 15:
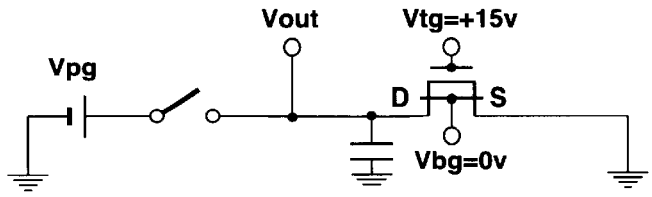
FIG. 15 is a view for illustrating a resetting operation of a double gate type photo sensor.

First, as shown in FIG. 13, a finger FN is placed on a protection insulation film 20 of the photo sensor system 100. At this time, although protrusions defining a finger print of the finger FN come into direct contact with the protection insulation film 20, inter-protrusion grooves do not contact into direct contact with the protection insulation film 20, and air is interposed there between. In the photo sensor system 100, when the finger FN is placed on the insulation film 20, as shown in FIGS. 14 and 15, a top gate driver 111 applies a signal (reset pulse; for example, a high level of Vtg=+15V) ϕTi to a top gate line 101 in the i-th line in accordance with a clock signal CK of the signal control group Tcnt from a controller 5. At this time, a bottom gate driver 112 applies a signal ϕBi of 0 (V) to the bottom gate line 102 in the i-th line, and makes a reset operation (reset period Treset) for discharging carriers (positive hole) stored in a semiconductor layer 11 of each double gate type photo sensor 10 and in the portion of a block insulation film 14 thereof.

Next, light in a wavelength region that includes visible light from a planar light source 30 provided at the downward of a glass substrate 19 of the double type photo sensor 10 is emitted to the double gate type photo sensor 10.

At this time, an opaque bottom gate electrode 22 is interposed between the planar light source 30 and the semiconductor 11. Thus, although emission light is hardly directly incident to the semiconductor layer 11, the light transmitting an opaque insulation substrate 19 and insulation films 15, 16, and 20 in an inter-element region Rp is emitted to the finger FN on the protection insulation film 20. Of the lights emitted to the finger FN, the Q1 light incident at an angle less than a critical angle of total reflection is randomly reflected on an interface between the protrusions of the finger FN and the protection insulation film 20 and on a surface skin of the finger FN. The reflected light is incident to the semiconductor layer 11 of the double gate type photo sensor 10 that is the closest via the insulation films 15 and 20 and the top gate electrode 21. The refraction index of the insulation films 15, 16, and 20 is set about 1.8 to 2.0, and the refraction index of the top gate electrode 21 is set to about 2.0 to 2.2. In contrast, in the groove of the finger FN, light Q2 is damped in air while the light is randomly refracted in the groove, and a sufficient quantity of light is not incident to the semiconductor layer 11 of the double gate type photo sensor 10 which is the closest.

That is, a quantity of carriers that can be generated and stored in the semiconductor layer 11 is displaced in accordance with an incident quantity of reflection light to the semiconductor layer 11 according to a finger print pattern of the finger FN.

Figure 16:
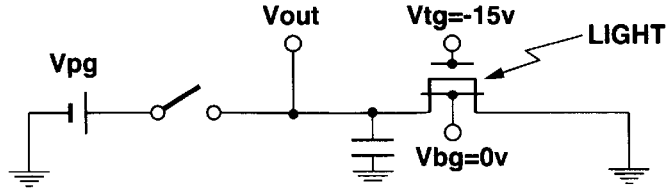
FIG. 16 is a view for illustrating a light detecting operation of the double gate type photo sensor.

As shown in FIGS. 14 and 16, the photo sensor system 100 terminates a reset operation by applying a bias voltage ϕTi at a low level (for example, Vtg=−15V) to a top gate line 101, and carries out a carrier storage operation in which a carrier storage period caused by the carrier storage operation starts.

In the carrier storage period Ta, electron—positive hole pairs are generated in the semiconductor layer 11 according to the light quantity incident from the top gate electrode 21. Then, positive holes are stored in the semiconductor layer 11 and in the part of the block insulation film 14 near the semiconductor layer 11, i.e., in the periphery of the channel region.

Figure 17:
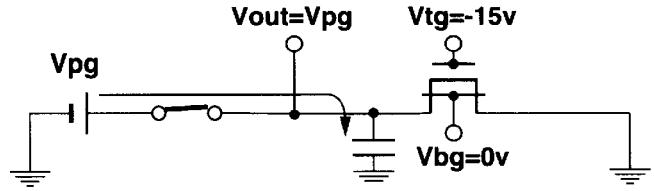
FIG. 17 is a view for illustrating a pre-charge operation of the double gate type photo sensor.

In a pre-charge operation, as shown in FIGS. 14 and 17, the switch 114 is turned ON based on a pre-charge signal ϕpg in parallel to a carrier storage period Ta. Then, a predetermined voltage (pre-charge voltage) Vpg is applied to the drain line 103, causing the drain electrode 13 to maintain a charge (pre-charge period Tprch).

Figure 18:
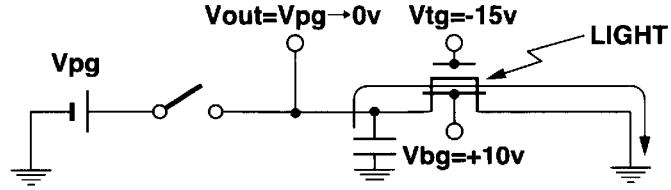
FIG. 18 is a view for illustrating a selection mode operation of the double gate type photo sensor in a bright state.

Next, in a readout operation, as shown in FIGS. 14 and 18, after the pre-charge period Tprch has elapsed, the bottom gate driver 112 turns ON the double gate type photo sensors 10 in a selection mode line by applying a bias voltage (readout selection signal; hereinafter, referred to as a readout pulse) ϕBi at a high level (for example, Vbg+10V) in the bottom gate line 102 of the selection bottom line in accordance with a clock signal CK of the signal control group Bcnt from the controller 5 (readout period Tread).

Here, in the readout period Tread, carriers (positive holes) stored in the channel region act to relax Vtg (−15V) in reverse polarity applied to the top gate terminal TG. Thus, a channel "n" is formed by Vbg of the bottom gate terminal BG. A drain line voltage VD of the drain line 103 is likely to gradually lower according to a drain current with an elapsed time from the pre-charge voltage Vpg.

Figure 19:
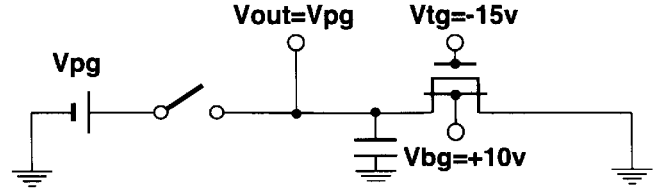
FIG. 19 is a view for illustrating a selection mode operation of the double gate type photo sensor in a dark state.

That is, where carriers (positive holes) are not stored in the channel region while a carrier storage state is a dark state in a carrier storage period Ta, as shown in FIGS. 19 and 22, a negative bias is applied to the top gate TG, whereby a positive bias of the bottom gate BG for forming a channel "n" is offset, and the double gate type photo sensor 10 is turned OFF. Then, a drain voltage, i.e., a voltage VD of the drain line 103 is substantially maintained as is.

On the other hand, where a carrier storage state is a bright state, as shown in FIG. 18 and FIG. 22, carriers (positive holes) are captured according to the light quantity incident to the channel region. Thus, the carriers act so as to offset a negative bias of the top gate TG, and the channel "n" is formed of a positive bias of the bottom gate BG by this offset, the double gate type photo sensor 10 is turned ON, and a drain current flows. Then, a voltage VD of the drain line 103 lowers in accordance with the drain current that flows according to this incident light quantity.

Therefore, as shown in FIG. 22, the change tendency of the voltage VD of the drain line 103 is deeply associated with the light quantity when light is received a time (carrier storage time Ta) between a time of the end of the reset operation caused by applying the reset pulse ϕTi to the top gate TG and a time when a readout pulse ϕBi is applied to the bottom gate BG. Where a small number of carriers are stored, it shows a tendency where the carriers gently lower. Where a large number of carriers are stored, it shows a tendency where the carriers rapidly lower. Therefore, the voltage VD of the drain line 103 after a predetermined elapse of time after the readout period Tred has started is detected, or a time giving rise to a predetermined threshold voltage defined as a reference is detected, whereby the light quantity of illumination light is computed.

While a series of the above described image readout operations is defined as one cycle, similar procedures are repeated for the double gate type photo sensors 10 in the (i+1)-th line, whereby the double gate type photo sensors 10 can be operated as a two-dimensional sensors system. In the timing chart shown in FIG. 14, after the pre-charge period Tprch has been elapsed, as shown in FIGS. 20 and 21, if a state where a low level (for example, Vbg=0V) is applied to the bottom gate line in non-selection mode is continued, the double gate type photo sensor 10 maintains its OFF state. As shown in FIG. 23, the voltage VD of the drain line 103 maintains a pre-charge voltage Vpg. In this way, a selection function for selecting a readout state of the double gate type photo sensor 10 is achieved according to a state where a voltage is applied to the bottom gate line 102. The pre-charge voltage VD of the drain line 103 damped according to the light quantity is read out to the detection driver 113 again. Then, the read out voltage is outputted in serial or parallel to a finger print pattern authentication circuit as a signal DATA amplified by the amplifier circuit 115.

Figure 24:
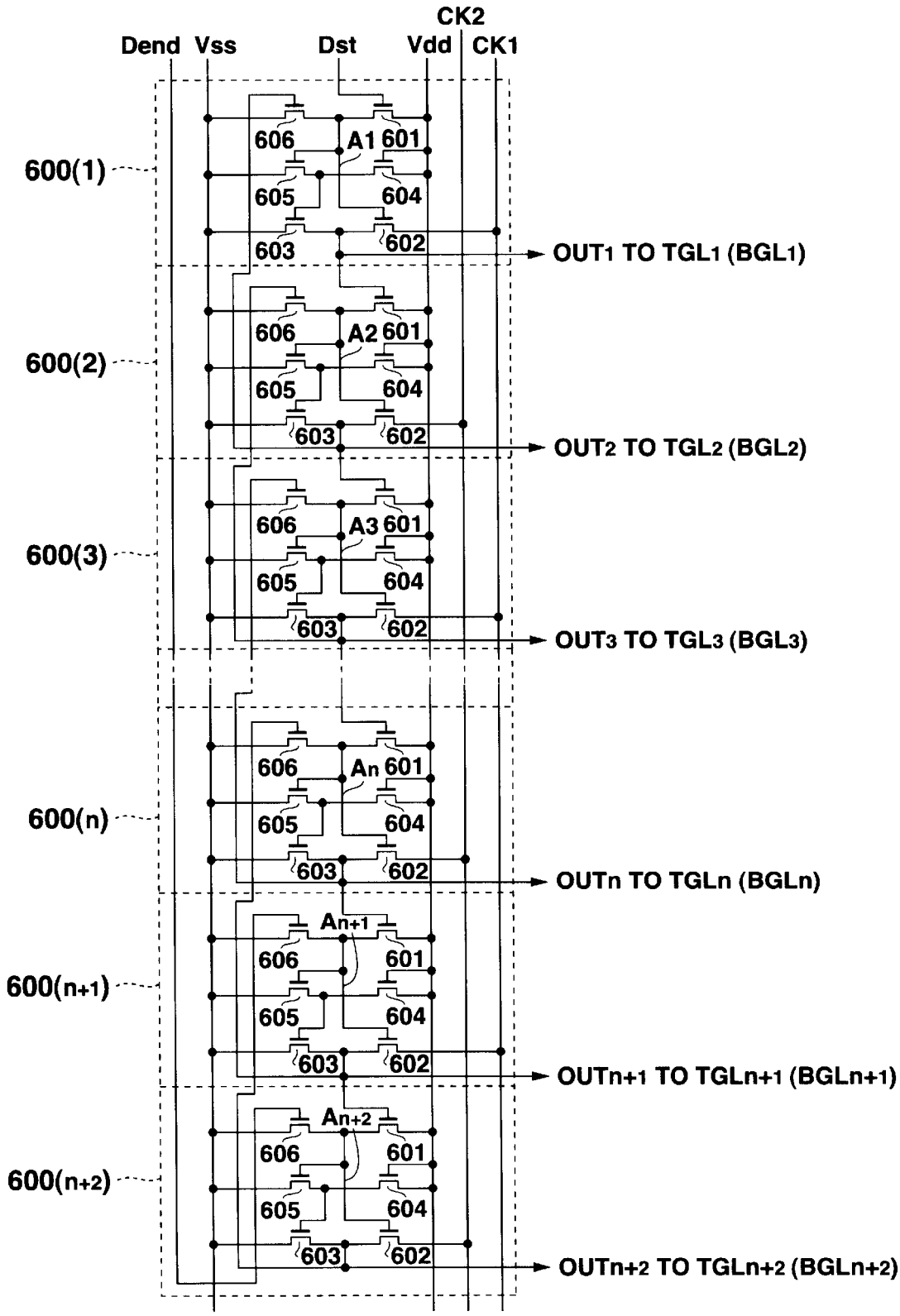
FIG. 24 is a view showing a circuit construction of a shift register that configures a gate driver connected to a top gate line or a bottom gate line of an image pick-up device according to one embodiment of the present invention.

The top gate driver 111 is connected to the top gate lines TGL1 to TGLn provided in the image pick-up region 6*a* and the dummy top gate lines TGLn+1 and TGLn+2 provided in the dummy element region 6*b*. This driver comprises a shift register shown in FIG. 24. The shift register is compose of: stages 600 (1) to 600 (*n*) that output respectively output signals OUT1 to OUTn to the top gate lines TGL1 to TGLn; and dummy stages 600 (*n*+1) and dummy stages 600 (*n*+2) that output respectively output signals OUT n+1 and OUTn+2 to dummy top gate lines TGLn+1 and TGLn+2. The shift register stages 600 (1) to 600 (*n*+2) each have the same structure as the stages 500 (1) to 500 (*n*+2) shown in FIG. 4. Transistors 601 to 606 each are formed integrally in accordance with a manufacturing process of the double gate type transistor 10 excluding the top gate electrode 21. Apart from a voltage value of an outputting signal, a signal amplitude period, and an amplitude timing, these transistors each generally have the same functions as the stage 500 (1) to 500 (*n*+2) shown in FIG. 4.

On the other hand, the bottom gate driver 112 is connected to the bottom gate lines BGL1 to BGLn provided in the image pick-up element region 6*a*; and the dummy bottom gate lines BGLn+1 and BGLn+2 provided in the dummy element region 6*b*. The gate driver 112 comprises a shift register shown in FIG. 24. This shift register is composed of: stages 600 (1) to 600 (*n*) that output respectively output signals OUT1 to OUTn to the bottom gate lines BGL1 to BGLn; and a dummy stage 600 (*n*+1) and a dummy stage 600 (*n*+2) that output respectively output signals OUTn+1 and OUTn+2 to the dummy bottom gate lines BGLn+1 and BGLn+2. The shift register stages 600 (1) to 600 (*n*+2) each have the same structure as those at the stages 500 (1) to 500 (*n*+2) shown in FIG. 4. Transistors 601 to 606 each are formed integrally in accordance with a manufacturing process of the double gate type transistor 10 excluding the top gate electrode 21. Apart from a voltage value of an outputting signal, a signal amplitude period, and an amplitude timing, these transistors each generally have the same functions as those at the stages 500 (1) to 500 (*n*+2) and function, as shown in FIG. 14. The transistor 604 functions as a load when the power voltage Vdd is supplied. From a drain of the transistor 604, the power voltage Vdd is supplied to a drain of the transistor 605 as is. The transistor 604 can be replaced with a resistor element other than TFT.

Figure 25:
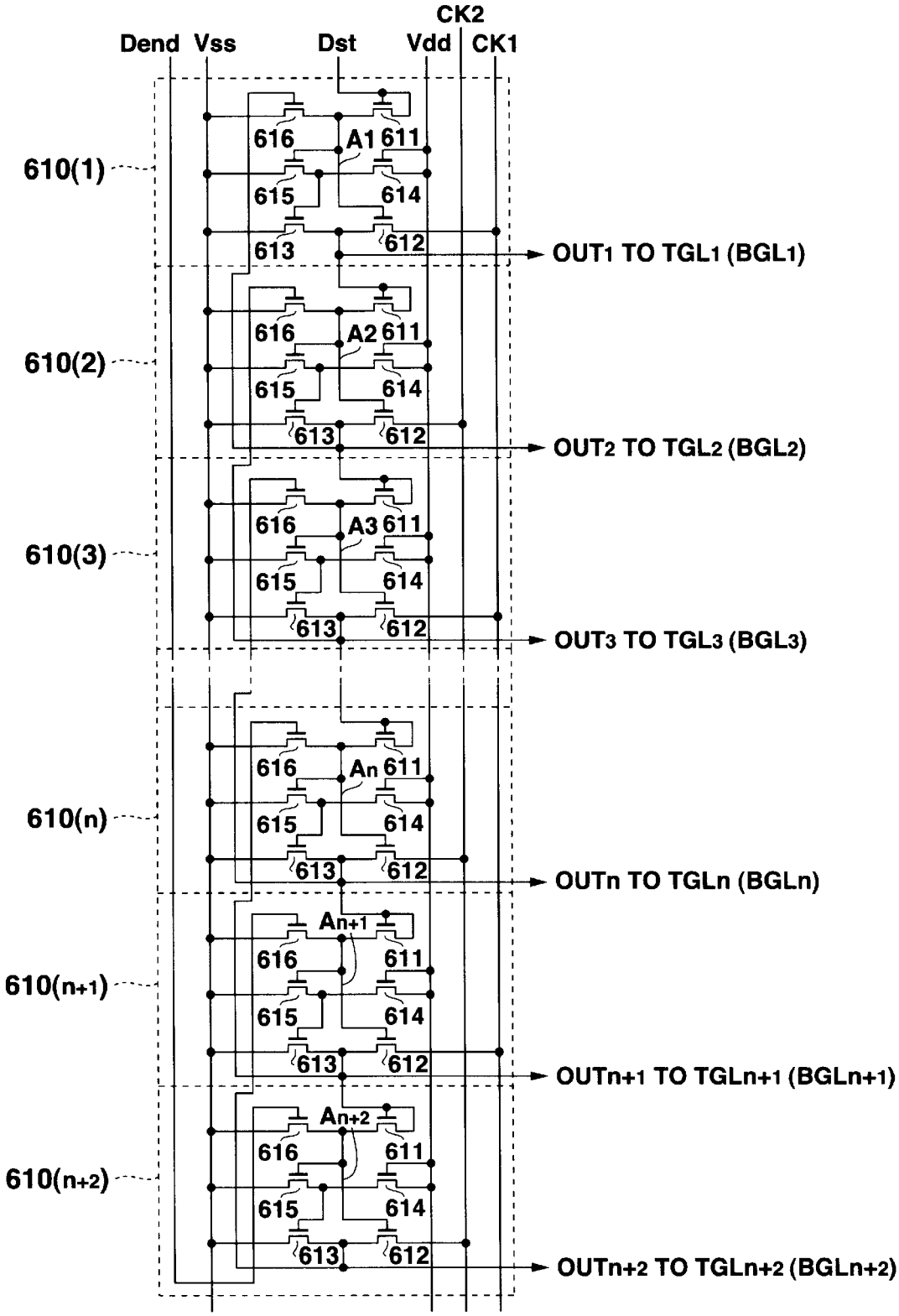
FIG. 25 is a view showing a circuit construction of another shift register that configures a gate driver connected to a top gate line or a bottom gate line of an image pick-up device according to one embodiment of the present invention.

In addition, a shift register as shown in FIG. 25 may be provided as the top gate driver 111 and the bottom gate driver 112. TFTs 612 to 616 at each of stage 610 (1) to stage 610 (*n*+2) of that shift register has the same structure as TFTs 602 to 606 at stage 600 (1) to stage 600 (*n*+2), respectively. TFT 611 at each of the stages 610 (1) to stage 610 (*n*+2) is different from TFT 601 at each of the stage 600 (1) to stage 600 (*n*+2) in that the drain electrode is connected to the gate electrode. However, like the stage 600 (1) to stage 600 (*n*+2), the transistor 611 operates as shown in FIG. 14. The transistor 614 functions as a load when the power voltage Vdd is supplied. From that drain, the power voltage Vdd is supplied to a drain of the transistor 615 as substantially is. The transistor 614 can be replaced with a resistor element or the like other than TFT.

The image pick-up element 6 is composed of a plurality of double gate type photo sensor or 10 disposed in matrix shape. A top gate electrode 21 of the double gate type transistor 10 is connected to the top gate line TGL. The bottom gate electrode 22 is connected to the bottom gate line BGL. The drain electrode 13 is connected to the drain line DL. The source electrode 12 is connected to the source line SL. Although a potential of the source line SL is always a reference voltage Vss, and may be different from a voltage pre-charged in the drain line DL, a grounding potential is desirable. As light in a wavelength region for exciting the semiconductor layer of the double gate type transistor 10, an emitting back light is placed downward of the image pick-up element 6.

The composite capacity in such each top gate electrode 21 and top gate lines TGL1 to TGLn is obtained as a summation of a capacity of the parasitic capacitance Ctgd between the top gate electrode 21 and the drain electrode 13; a capacity of the parasitic capacitance Ctgs between the top gate electrode 21 and the source electrode 21; a capacity of the parasitic capacitance Cge between the top gate electrode 21 and the bottom gate electrode 22; and a capacity of the superimposed capacitance Cgl between the top gate line TGL and the bottom gate line BGL.

The composite capacity of bottom gate electrodes 21 and the bottom gate lines BGL1 to BGLn, excluding the parasitic capacitance Cge and the superimposed capacitance Cgl is a summation capacity of the parasitic capacitance Cbgd between the bottom gate electrode 21 and drain electrode 13 and the parasitic capacity Cbgs between the bottom gate electrode 21 and the source electrode 12 in the connected double gate type transistor 10.

Figure 26:
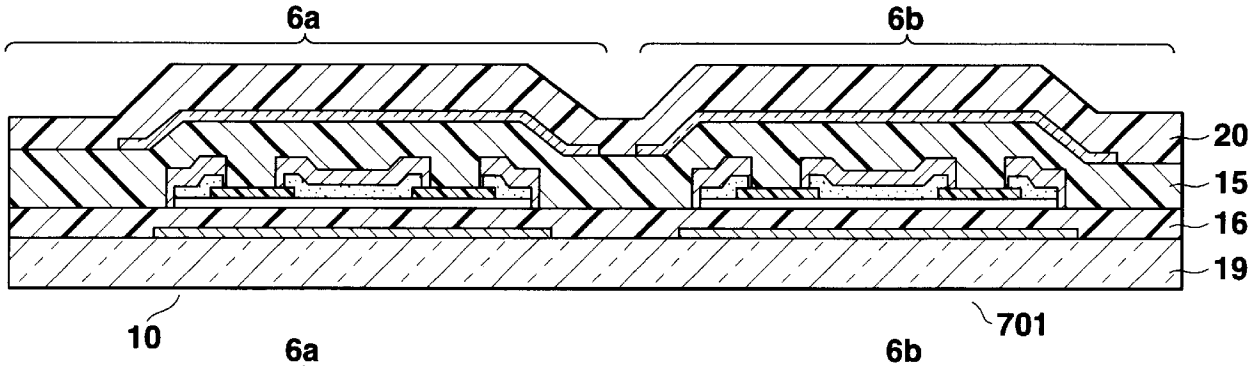
FIG. 26 is a sectional view showing an image pick-up element provided in an image pick-up element region and a dummy element provided in a dummy element region, the dummy element having a parasitic capacitance equivalent to the image pick-up element.

The element shown in FIG. 26 comprises: the double gate type transistor 10 provided in the image pick-up element region 6*a*; and a dummy double gate type transistor 701 provided in the dummy element region 6*b* and having its parasitic capacitance equal to that of the double gate type transistor 10. The dummy double gate type transistor 701 has the substantially same structure as the double gate type transistor 10. Like the double gate type transistor 10, it is preferable that the dummy TGL double gate type transistor 701 be connected to a top gate line TGL, a bottom gate line BGL, a drain line DL, and a source line SL, respectively. In this case, a detection driver 113 operates in the same way as the double gate type transistor 10 relevant to the dummy double gate type transistor 701. This driver is set so as not to output image data DATA caused by the dummy double gate type transistor 701 to the controller 5 or so as not to cause the controller 5 to use the image data DATA even if it is outputted.

"m" double gate type transistors 10 are connected respectively to a group of "n" dummy top gate lines and "n" dummy bottom lines (TGLn+1-BGLn+1) to (TGLn+2-BGLn+2) "m" double gate type transistors 10 are connected to two group of top gate lines and bottom gate lines, (TGL1-BGL1) to (TGLn-BGLn).

Thus, the parasitic capacitance of a respective one of a pair (TGLn+1-BGLn+1) and a pair (TGLn+2-BGLn+2) of dummy top gate lines and dummy bottom gate lines is equal to that of a respective one of the group (TGL1-BGL1) to group (TGLn-BGLn) of top gate lines and bottom gate lines.

Therefore, the top gate driver 111 can output uniform output signals OUT1 to OUTn free of distortion to the top gate lines TGL1 to TGLn provided in the image pick-up element region 6*a*. The bottom gate driver 112 can output uniform output signals OUT1 to OUTn free of distortion, to the bottom gate lines BGL1 to BGLn provided in the image pick-up element region 6*a*. Thus, image can be normally picked up.

Figure 27:
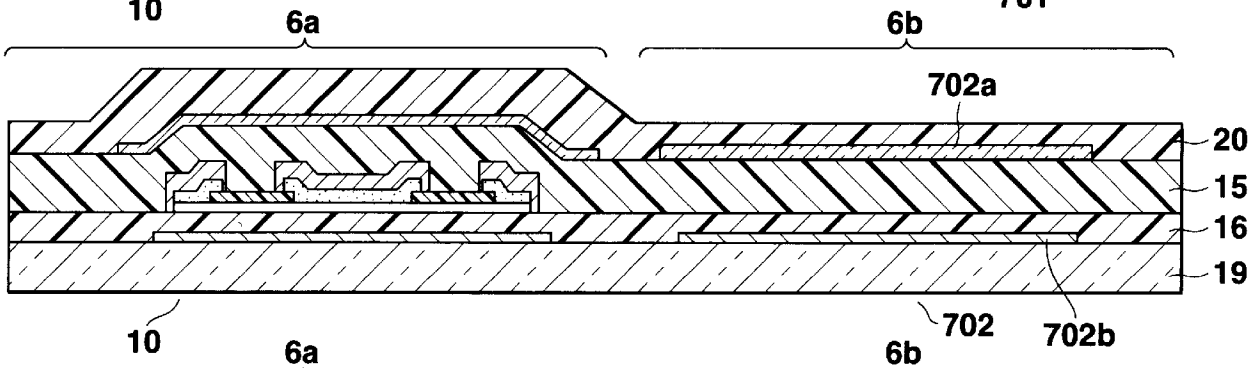
FIG. 27 is a sectional view showing another dummy element having its parasitic capacitance equivalent to the image pick-up element provided in the image pick-up element region.

In the above embodiment, the dummy double gate type transistors 701 are provided at a dummy stage 600 (*n*+1) and a dummy stage 600 (*n*+2), respectively, so that a capacity of the parasitic capacitance of the group the dummy top gate line and dummy bottom gate line is equal to that of the capacitance of the group of the top gate lines and bottom gate lines. As shown in FIG. 27, "m" dummy parasitic capacities 702 each composing of: a dummy top gate line TGL, a dummy bottom gate line BGL, a dummy top gate electrode 702*a* connected to the dummy top gate line TGL, a dummy bottom gate electrode 702*b* connected to the dummy bottom gate line BGL; and insulation films 15 and 16 interposed between them may be provided, respectively, at the dummy stage 600 (*n*+1) and the dummy stage 600 (*n*+2). The insulation films 15 and 16 interposed at a superimposed position of the dummy top gate line TGL and dummy top gate electrode 702*a* and dummy bottom gate line BGL and dummy bottom gate electrode 702*b* are obtained as dielectric, and the parasitic capacitance 702 composed of these elements is designed so as to be equal to the parasitic capacitance of the double gate type transistor 10. The parasitic capacitance 702 can be set by superimposed areas between the dummy top gate line TGL and dummy top gate electrode 702*a* and between the dummy bottom gate line BGL and dummy bottom gate electrode 702*b*.

Figure 28:
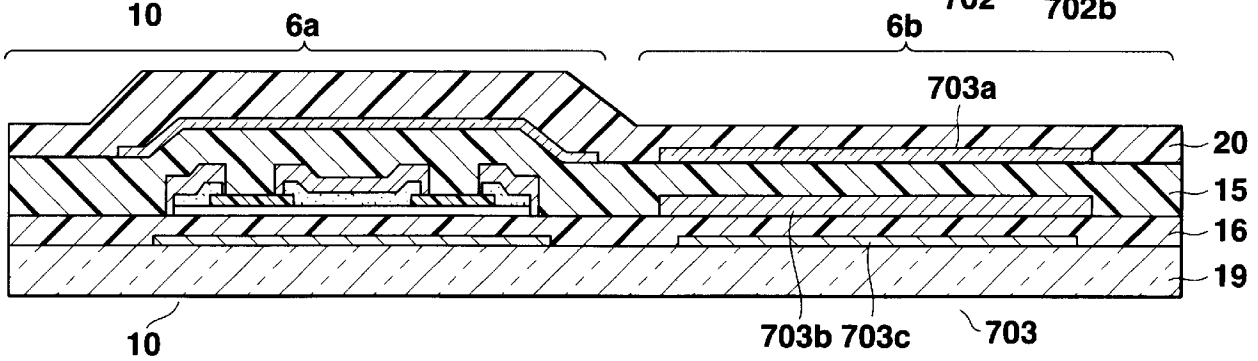
FIG. 28 is a sectional view showing another dummy element having its parasitic capacitance equivalent to the image pick-up element provided in the image pick-up element region.

As the other embodiment, as shown in FIG. 28, at the dummy stage 600 (*n*+1) and dummy stage 600 (*n*+2), respectively, there may be provided "m" dummy parasitic capacities 703 each composed of: a dummy top gate electrode 703*a* connected to a dummy top gate line TGL, and a dummy bottom gate line BGL, a dummy bottom electrode 703*c* connected to a dummy gate bottom gate line BGL; a dummy intermediate electrode 703*b* formed of the same material as that of the source and drain electrodes 12 and 13 of the double gate type transistor 10 and in accordance with the same manufacturing process, the dummy intermediate electrode being connected to the drain line DL; and insulation films 15 and 16 interposed between these elements. A capacity of the parasitic capacitance 703 composed of these elements is designed so as to be equal to that of the parasitic capacitance of the double gate type transistor 10. The parasitic capacity 703 can be set by mutually superimposed areas between the dummy top gate line TGL and dummy top gate electrode 703*a* and between the dummy bottom gate line BGL and dummy bottom gate electrode 703*c*.

Figure 29:
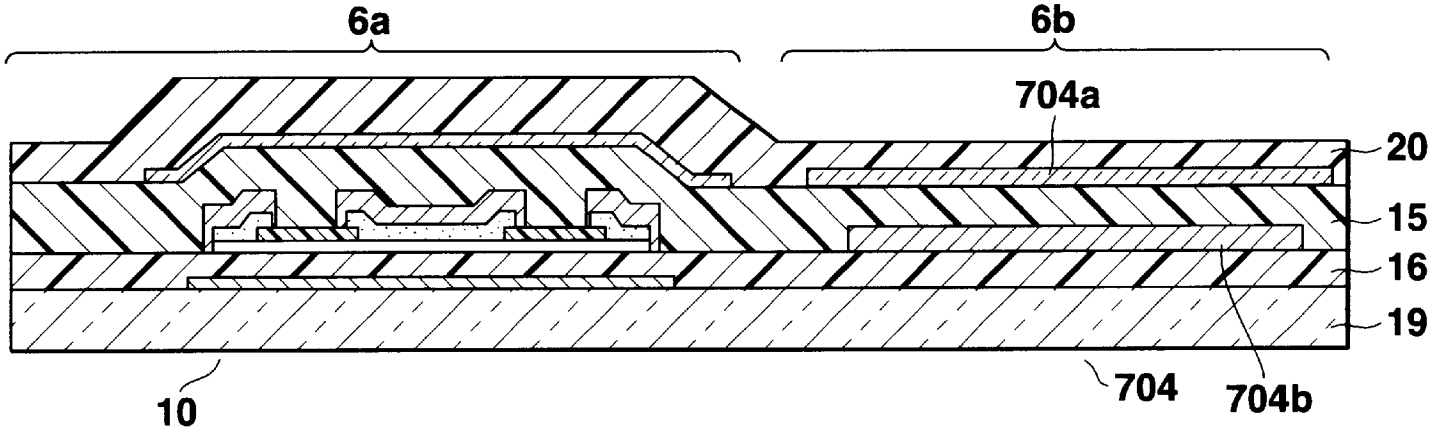
FIG. 29 is a sectional view showing another dummy element having its parasitic capacitance equivalent to the image pick-up element provided in the image pick-up element region.

In addition, as shown in FIG. 29, at the dummy 25 stage 600 (*n*+1) and dummy stage 600 (*n*+2), respectively, there may be provided "m" dummy parasitic capacities 704, each composed of: a dummy top gate 704*a* connected to a dummy top gate line TGL, and a dummy bottom gate line BGL, a dummy electrode 704*b* formed of the same material as the source and drain electrodes 12 and 13 of the double gate type transistor 10 and in accordance with the same manufacturing process, the dummy electrode being connected to a drain line DL; a dummy bottom gate line BGL, and insulation films 15 and 16 interposed between these elements. The parasitic capacitance 704 composed of these elements is designed so that a capacity of the parasitic capacitance 704 is equal to that of the parasitic capacitance of the double gate type transistor 10. The parasitic capacitance 704 can be set by a mutually superimposed areas among the dummy top gate lines TGL and dummy top gate electrode 704*a*, the dummy bottom gate line BGL, and the dummy electrode 704*b*.

Figure 30:
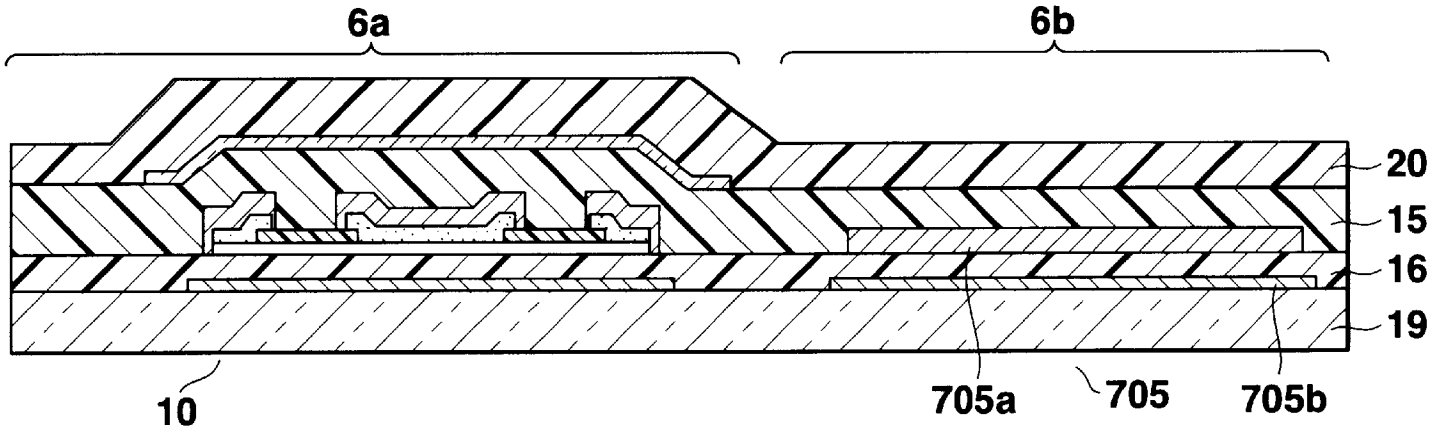
FIG. 30 is a sectional view showing another dummy element having its parasitic capacitance equivalent to the image pick-up element provided in the image pick-up element region.

Further, as shown in FIG. 30, at the dummy stage 600 (*n*+1) and dummy stage 600 (*n*+2), respectively, there may be provided "m" dummy parasitic capacities 705 composed of: a dummy top gate line TGL; a dummy bottom gate line BGL; a dummy top gate line TGL; a dummy electrode 705*a* formed of the same material as the source and drain electrodes 12 and 13 of the double gate type transistor 10 and in accordance with the same manufacturing process, the dummy electrode being connected to the drain line DL; a dummy bottom gate electrode 705*b* connected to the dummy bottom gate line BGL; insulation films 15 and 16 interposed between these elements. The parasitic capacitance 705 composed of these elements is designed so that a capacity of the parasitic capacitance 705 is equal to that of the parasitic capacitance of the double gate type transistor 10. The parasitic capacitance 705 can be set by a mutually superimposed area among the dummy top gate line TGL, the dummy bottom gate line BGL and dummy bottom gate electrode 705*b*, and the dummy electrode 705*a*.

A top gate driver 111 is connected to the top gate line TGL of the image pick-up element 6, and a signal of +15 (V) or −15 (V) is selectively outputted to each top gate line TGL, in accordance with a control signal group Tcnt from the controller 5. The top gate driver 111 has the substantially same construction as a shift register that configures the above described gate driver 52 excluding a difference in output signal levels, a difference in input signal levels according to the output levels, a difference in output signal and input signal phases.

A bottom gate driver 112 is connected to the bottom gate lines BGL of the image pick-up element 6, and a signal of +10 (V) or 0 (V) is outputted to each bottom gate line BGL in accordance with a control signal group Bcnt from the controller 5. The bottom gate driver 112 has the substantially same construction as the shift register that configures the above described gate driver 52 excluding a difference in output signal levels, a difference in input signal levels according to the output levels, a difference in output signal and input signal phases.

A detection driver 113 is connected to the drain lines DL of the image pick-up element 6 and a constant voltage (+10 (V)) is outputted to all drain lines DL in a predetermined period described later in accordance with a control signal group Vpg from the controller 5, so that a charge is pre-charged. The detection driver 113 reads out the potential of each drain line DL that changes according to whether or not a channel is formed according to the incidence or non-incidence of light to a semiconductor layer of the double gate type transistor 10 during a predetermined period after pre-charge, and outputs image data DATA to the controller 5.

The controller 5 controls the top gate driver 111 and the bottom gate driver 112, respectively, in accordance with control signal groups Tcnt and Bcnt, causing thus to output a predetermined level signal at a predetermined timing for each line. In this manner, lines of the image pick-up element 6 each are set to a sequential reset state, a photo sense state, and a readout state. The controller 5 causes the control signal group Vpg to read out a potential change of the drain line DL by using a drain driver 9, and sequentially acquires image data DATA.

Although the above embodiments each have described an example when a TFT is applied as an active element according to the present invention, another active element such as MIM (Metal Insulator Metal) as well can be applied. In addition, apart from an electronic device in which a gate driver and a drain driver are formed on the same substrate as the liquid crystal display element or image pick-up element, the present invention can be applied to an electronic device additionally formed and mounted on the liquid crystal display element or image pick-up element as well.

In the embodiments each of the above liquid crystal display device, a compensation capacitance is provided as part of a load of a respective one of gate lines GLn+1 and GLn+2 in the dummy element region 49. However, a load of a respective one of the gate lines GLn+1 and GLn+2 in the dummy element region 49 in a structure in which a compensation electrode CE is not provided in pixels connected to "n" gate lines GL1 to GLn, respectively, arranged in the display region 48, may be set so that the compensation capacitance of pixels is excluded from a load from a respective one of the gate lines GLn+1 and GLn+2 in the dummy element region 49 in the above embodiments each.

In the embodiments each of the above liquid crystal display device, although two gate lines GLn+1 and GLn+2 are provided in the dummy element region 49, only one gate line GLn+1 may be provided, and a gate driver 2 may be constructed at stages 500 (1) to 500 (*n*+1).

In the embodiments each of the above image pick-up device, in the dummy element region 6*a*, although there has been provided a group of top gate line TGLn+1 and bottom gate line BGLn+1, and a group of top gate line TGLn+2 and bottom gate line BGLn+2, only a group of top gate line TGLn+1 and bottom gate line BGLn+1 is constructed, and the top gate driver 111 and bottom gate driver 112 as well may be constructed as stage 600 (1) to stage 600 (*n*+1) and stage 610 (1) to stage 610 (*n*+1).

Although the number of dummy elements provided at one dummy top gate line TGL or dummy bottom gate line BGL described in the embodiments each is equal to the number of pixels provided in one top gate line TGL or bottom gate line BGL. However, if a capacity of the one dummy top gate line TGL or dummy bottom gate BGL is equal to the total capacity of the capacitance of pixels provided in one top gate line TGL or bottom gate line BGL, the number of dummy elements in the one dummy top gate line TGL or dummy gate BGL may be different from that of pixels in the one dummy top gate line TGL or dummy bottom gate BGL, for example, like only one dummy parasitic capacitance element.

Although the above embodiments each have described a liquid crystal display device and optical image pick up device, the present invention can be applied to an electroluminescence device, a plasma display device, a field emission display device, or an electrostatic capacitance type image pick-up device as well without being limited thereto.

What is claimed is:

1. An electric circuit comprising:

a plurality of wires provided in an image pick-up region of a substrate;

a plurality of image pick-up elements respectively connected to the plurality of wires;

a dummy wire provided in a dummy element region of the substrate;

a dummy element connected to the dummy wire so that a parasitic capacitance at a respective one of the plurality of wires is equal to that at the dummy wire; anc a shift register connected to the plurality of wires provided in the image pick-up element region and the dummy wire provided in the dummy element region, at least one stage of the shift register including:

a first transistor having a first control terminal, the first transistor being turned ON by a predetermined level signal supplied to the first control terminal from a frontal stage, and outputting the predetermined level signal or a constant voltage signal from a first end of a first current path of the first transistor;

a second transistor having a second control terminal, the first transistor being turned ON according to a voltage applied to a wire between the second control terminal and second end of the first current path of the first transistor, and outputting an output signal from a first end of a second current path of the second transistor while a first or second signal supplied to a second end of the second current path of the second transistor is externally defined as the output signal;

a load that outputs a power voltage to be externally supplied;

a third transistor having a third control terminal, the third transistor being turned ON according to a voltage applied to a wire between the third control terminal and the second end of the first current path of the first transistor, and resetting the power voltage output from the load to a first end of a third current path of the third transistor, the power voltage from the load being displaced with a predetermined level voltage from the second end of the third current path of the third transistor; and a fourth transistor having a fourth control terminal, the fourth transistor being turned ON according to a voltage applied to a wire between the fourth control terminal and the load, a first of a fourth current path of the fourth transistor being connected to the first end of the second current path of the second transistor, and outputting a reference voltage from the first end of the fourth current path via a second end of the fourth current path.

2. An electric circuit according to claim 1, wherein each of the plurality of image pick-up elements comprises:

a first gate electrode;

a first gate insulation film disposed upwardly of the first gate electrode;

at least one semiconductor layer disposed upwardly of the first gate insulation film;

source and drain electrodes for supplying a drain current to the semiconductor layer;

a second gate insulation film disposed upwardly of the semiconductor layer; and a second gate electrode provided upwardly of the second gate insulation film.

3. An electric circuit according to claim 2, wherein the first gate electrode and the second gate electrode of each of the plurality of image pick-up elements are connected to the plurality of different wires, respectively.

4. An electric circuit according to claim 1, further comprising a shift register connected to the plurality of wires provided in the image pick-up region and the dummy wire provided in the dummy element region, the shift register having a plurality of stages according to the plurality of wires and the dummy wire, at least one stage of the plurality of stages being driven according to a signal from a next stage of the plurality of stages.

5. An electric circuit according to claim 1, wherein each of the plurality of image pick-up elements has two gate electrodes, the two gate electrodes being connected to the plurality of different wires, respectively.

6. An electric circuit according to claim 1, wherein the shift register comprises a fifth transistor having a fifth control terminal, the fifth control terminal being turned ON by an output signal at a rear stage, thereby resetting a voltage applied to the wire between the second control terminal of the second transistor and the second end of the first current path of the first transistor.

7. An electric circuit according to claim 1, wherein a stage of the shift register that corresponds to the dummy wire controls a stage of the shift register that corresponds to at least one of the plurality of wires provided in the image pick-up element region by outputting an output signal.

8. An electric circuit according to claim 1, wherein the dummy element has a structure equal to the image pick-up element.

9. An electric circuit according to claim 1, wherein the dummy element is composed of part of the image pick-up element.

* * * * *